US011867006B2

(12) United States Patent
Bender et al.

(10) Patent No.: US 11,867,006 B2
(45) Date of Patent: Jan. 9, 2024

(54) SEMI-AUTOMATIC OR AUTOMATIC CONTROL OF DRILLING TOOL CHANGING SYSTEM

(71) Applicant: Epiroc Drilling Solutions, LLC, Garland, TX (US)

(72) Inventors: Luke Bender, Sachse, TX (US); Gavin Maestas, Richardson, TX (US); Taylor Wilkin, Sachse, TX (US); Matthew Fosler, Garland, TX (US); Samyuktha Pericharla, Bangalore (IN); Tyler Berens, Garland, TX (US)

(73) Assignee: Epiroc Drilling Solutions, LLC, Garland, TX (US)

( * ) Notice: Subject to any disclaimer, the term of this patent is extended or adjusted under 35 U.S.C. 154(b) by 0 days.

(21) Appl. No.: 17/893,334

(22) Filed: Aug. 23, 2022

(65) Prior Publication Data

US 2023/0038886 A1 Feb. 9, 2023

Related U.S. Application Data

(63) Continuation-in-part of application No. 17/161,880, filed on Jan. 29, 2021, now Pat. No. 11,466,522.

(60) Provisional application No. 63/235,855, filed on Aug. 23, 2021.

(51) Int. Cl.
*E21B 19/18* (2006.01)

(52) U.S. Cl.
CPC ..... *E21B 19/18* (2013.01)

(58) Field of Classification Search
CPC ..... E21B 19/18; E21B 19/20
See application file for complete search history.

(56) References Cited

U.S. PATENT DOCUMENTS

| | | | | |
|---|---|---|---|---|
| 6,457,526 | B1 * | 10/2002 | Dailey | E21B 21/001 166/356 |
| 8,342,236 | B2 * | 1/2013 | Bienfang | E21B 19/18 166/77.51 |
| 11,466,522 | B2 * | 10/2022 | Fosler | E21B 19/146 |
| 2014/0083774 | A1 * | 3/2014 | Hoult | E21B 17/00 175/52 |
| 2014/0338973 | A1 * | 11/2014 | Taylor | E21B 19/146 175/24 |
| 2018/0291696 | A1 * | 10/2018 | Amerson | E21B 19/18 |
| 2022/0018196 | A1 * | 1/2022 | Gregg | B63B 27/10 |

FOREIGN PATENT DOCUMENTS

WO WO-2019226096 A1 * 11/2019 ..... E21B 1/00

* cited by examiner

*Primary Examiner* — Matthew R Buck
(74) *Attorney, Agent, or Firm* — Shannon W. Bates; Harper & Bates LLP

(57) ABSTRACT

A method is disclosed for semi-automatic or automatic control of a system for changing drilling tools for a drilling rig that includes a drill tower supporting a drill string with a drill pipe at a lowermost end, and a drilling tool changer assembly having a rotatable carousel assembly with a plurality of bit adaptors for holding drilling tools. The method includes removing a first drilling tool attached to the drill pipe and attaching a second drilling tool held in the rotatable carousel assembly to the drill pipe. The method may selectively be performed semi-automatically or automatically via a control system operatively coupled to the drilling rig.

19 Claims, 22 Drawing Sheets

SEMI-AUTOMATIC OR AUTOMATIC CONTROL OF DRILLING TOOL CHANGING SYSTEM

CROSS-REFERENCE TO RELATED APPLICATIONS

This application claims priority to, and the benefit of, U.S. Provisional Patent Application Ser. No. 63/235,855 filed Aug. 23, 2021, and entitled "Automatic Control of Drilling Tool Changing System," and this application is a continuation-in-part of U.S. patent application Ser. No. 17/161,880 filed Jan. 29, 2021 and entitled "Drilling Tool Changer Apparatus," the disclosures of which are incorporated herein by reference in their entirety.

TECHNICAL FIELD

This disclosure relates to drilling systems and more particularly to a drilling tool changer apparatus for use in applications such as mining, blast-hole drilling and other down-hole drilling applications. In particular, this disclosure relates to control systems and software processes for semi-automatic or automatic control of a drilling tool changer apparatus.

BACKGROUND

This background section provides a context to the implementations of the disclosure recited in the claims. The description here may include concepts that could be pursued, but are not necessarily ones that have been previously conceived or pursued. Therefore, unless otherwise indicated, what is described in this section is not prior art to the description and claims in this application and is not admitted to be prior art by inclusion in this section.

Drilling systems generally have a vertical drill tower, or mast, constructed from structural members such as steel beams and reinforcing supports. The drill tower is often coupled to a mobile platform, usually self-propelled, for positioning the drill tower in a desired location to conduct a drilling operation. The drill tower is often equipped with a drill magazine or holder of some sort, which is adapted to support a drill string formed from a combination of drill extenders, usually called drill rods or drill pipes. The drill magazine is used to selectively add the drill pipes to the drill string for drilling a hole having a desired depth. The drill magazine is intended to allow a drilling operation to progress into the drill hole by making readily available a continuous string of drill pipes as needed for advancing a drilling tool into a drill hole.

The lowermost drill pipe in the drill string is configured to receive a drilling tool at its lower end to conduct the drilling operation. The drilling tool is usually a drill bit or a down-hole hammer tool, but could be a sub with a drilling tool attached. (In this disclosure, the term "drill bit" may be used interchangeably for the general term "drilling tool", and the term "drill pipe" may be used interchangeably for the term "drill string", unless the context requires otherwise.) After a certain amount of usage in the drilling operation it is often desirable or necessary to remove and replace the drilling tool due to accumulated wear of an in-service drill bit, or the need to change between a drill bit and a hammering tool (or vice versa), or the need to change to a more or less aggressive drilling tool, or the need to change to a different diameter drilling tool, etc. In order to minimize downtime in the drilling operation due to change-out of drilling tools, mechanisms may be provided to facilitate removing one drilling tool from the end of the drilling string and replacing it with another drilling tool from a storage or supply location.

What is needed are control systems and software processes that selectively employ semi-automatic or automatic methods for changing drilling tools selected from a rotatable carousel to minimize downtime during change-outs and to minimize the number of personnel required at the drilling rig.

SUMMARY

The present disclosure is directed to systems and methods for semi-automatically or automatically changing drilling tools for a drilling rig that includes a drill tower supporting a drill string with a drill pipe at the lowermost end, and a drilling tool changer assembly having a rotatable carousel assembly with a plurality of bit adaptors for holding drilling tools. In some implementations, a method for changing drilling tools for a drilling rig includes removing a first drilling tool attached to a drill pipe and attaching a second drilling tool held in a rotatable carousel assembly to the drill pipe. In some implementations, the method is performed automatically or semi-automatically via a control system operatively coupled to the drilling rig. In some implementations, when the method is performed semi-automatically, a user identifies to the control system which one or more steps of the method to perform automatically.

In an implementation, the method further includes, before removing the first drilling tool attached to the drill pipe, moving a drill tower on the drilling rig from a storage position to an exchange position and moving a drilling tool changer assembly on the drilling rig from a storage position to an exchange position. In an implementation, the method further includes, after attaching the second drilling tool held in the rotatable carousel assembly to the drill pipe, moving the drill tower from the exchange position to the storage position and moving the drilling tool changer assembly from the exchange position to the storage position. In an implementation, the method further includes setting the second drilling tool attached to the drill pipe as the effective bit, and tracking one or more of the following for the effective bit: a serial number, a type of bit, a diameter of bit, an aggressiveness of bit, and an operational parameter associated with use.

In an implementation, removing the first drilling tool from the drill pipe includes rotating a rotatable carousel assembly on the drilling rig to bring a first bit adaptor that is initially empty into substantially coaxial alignment with the drill pipe. The removing step may further include placing the first drilling tool attached to the drill pipe into the first bit adaptor, breaking a first joint between the first drilling tool and the drill pipe, and feeding up the drill pipe. The method may further include taking a sensor reading to determine whether the placing step was successful. If the placing step was unsuccessful, the placing step may be reattempted by feeding up the drill pipe, rotating the drill pipe, and feeding down the drill pipe to place the first drilling tool attached to the drill pipe into the first bit adaptor. If the placing step was successful, the method may further include updating an availability status of the first bit adaptor to indicate the first bit adaptor contains the first drilling tool.

In an implementation, removing the first drilling tool from the drill pipe may include tightening the drill string before breaking the first joint, wherein tightening the drill string comprises rotating the drill string in a clockwise direction.

In an implementation, breaking the first joint includes loosening the first joint with a breakout wrench and rotating the drill pipe in a counterclockwise direction to unthread the first drilling tool from the drill pipe. Breaking the first joint may further include rotating the drill pipe in a counterclockwise direction to engage the first drilling tool against a set of nubs in the first bit adaptor before loosening the first joint with the breakout wrench.

In an implementation, attaching the second drilling tool held in the rotatable carousel assembly to the drill pipe includes rotating the rotatable carousel assembly to bring the second drilling tool held in a second bit adaptor into substantially coaxial alignment with the drill pipe, threading the second drilling tool onto the drill pipe, and feeding up the drill pipe. The method may further include taking a sensor reading to determine whether the threading step was successful. In an implementation, if the threading step was successful, the method includes updating an availability status of the second bit adaptor to indicate the second drilling tool was removed and the second bit adaptor is empty.

In an implementation, threading the second drilling tool onto the drill pipe includes rotating the drill pipe in a counter clockwise direction while feeding down the drill pipe toward the second drilling tool, engaging and aligning the drill pipe and the second drilling tool, rotating the drill pipe in a clockwise direction to thread onto the second drilling tool, and tightening a second joint between the drill pipe and the second drilling tool. In an implementation, the method includes pre-determining a number of rotational pulses of the drill pipe in the clockwise direction required to tighten the second joint, counting an actual number of rotational pulses of the drill pipe in the clockwise direction to tighten the second joint, and issuing a cross thread error if the counted number of rotational pulses is lower than the pre-determined number of rotational pulses. In some implementations, the actual number of rotational pulses is counted using an amplified sensor.

The details of one or more implementations are set forth in the accompanying drawings and the description below. Other features, objects, and advantages of the implementations will be apparent from the description and drawings.

BRIEF DESCRIPTION OF THE DRAWINGS

Non-limiting implementations of the present disclosure are described by way of example in the following drawings, which are schematic and are not intended to be drawn to scale:

FIG. 9 comprises perspective views of an implementation of the carousel of the drilling tool changer assembly.

FIG. 12 comprises views of the rotatable carousel of the drilling tool changer assembly, where

FIG. 13 comprises perspective views of bit adaptors.

FIG. 14 comprises perspective views of an implementation of the bit adaptors for the drilling tool changer. FIG. 14B shows a typical bit adaptor.

Like reference symbols in the various drawings indicate like elements.

DETAILED DESCRIPTION

Figure 1:
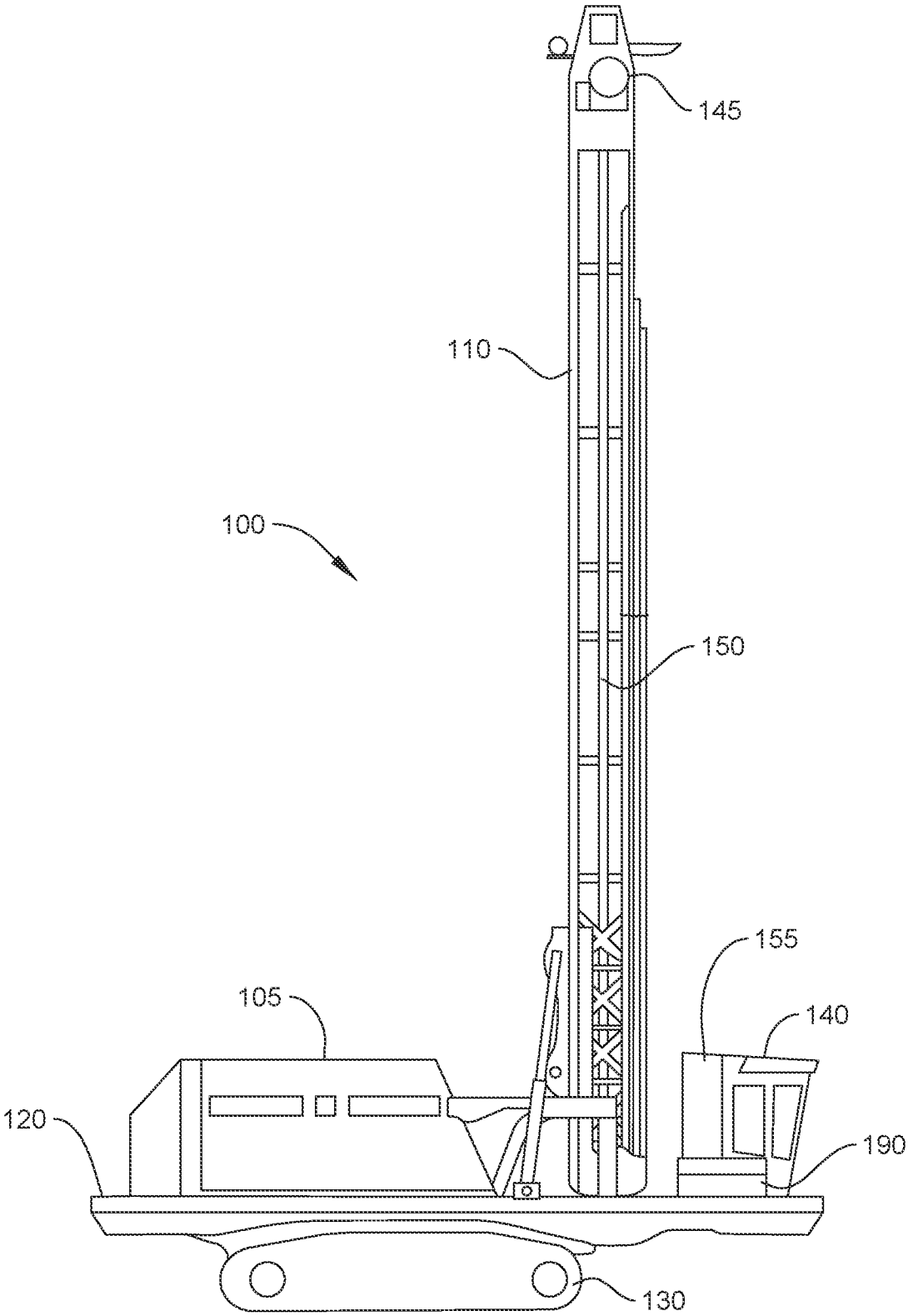
FIG. 1 shows a side view of an implementation of a typical drilling machine having a tower capable of tilting, where the tower is raised to a vertical position.

FIG. 1 shows a side view of a typical mobile drilling machine 100. The drilling machine has a tower 110, a platform 120 supporting the tower 110, and typically tracks 130 or wheels for propelling the drilling machine over ground. FIG. 1 also shows an operator's cab 140 situated on the platform 120. The term "cab" in this disclosure refers to either a housing for an operator or a workstation location on the platform 120, which may or may not be occupied by an operator; the latter would be the case in autonomous machines. FIG. 1 shows the typical engine compartment or "power pack" 105, and mechanical accessories of a drilling machine 100. The tower 110 will also carry a drill string 150 extending through the tower 110, and a rotary head 145, being typically a hydraulic or electric motor for rotating the drill string 150. The drill string 150 is terminated at its lower end by a removable bit or drilling tool 215. In general, the tower 110 is pivotably moveable so that its tilt allows operations for the change-out of drilling tools 215. The drill string 150 and its components will be discussed in more detail below. The reader should note that the improvements disclosed here could be embodied in a fixed drilling machine as well as the mobile machine illustrated, and the claims cover both implementations.

Figure 2:
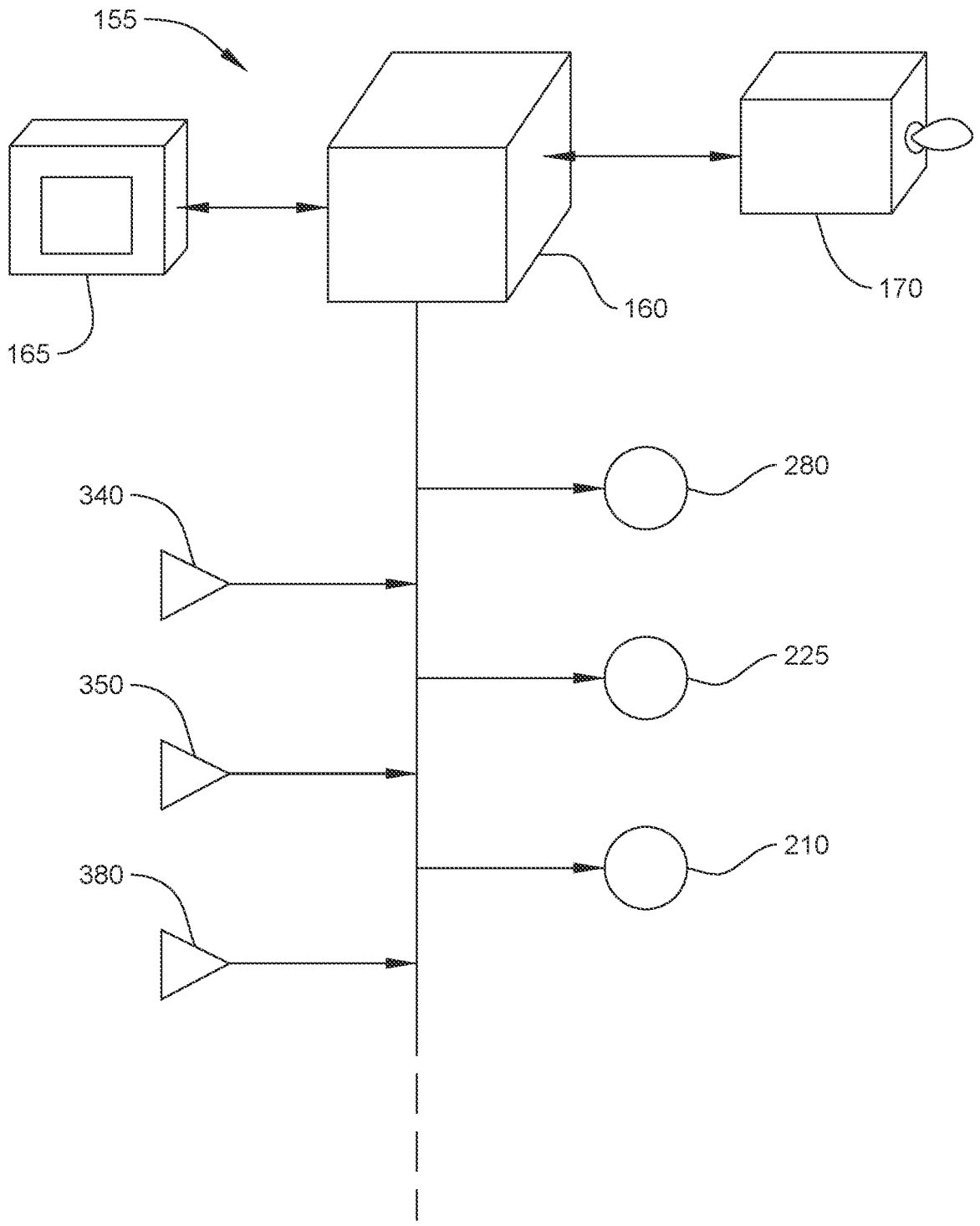
FIG. 2 shows schematically a general control system of the drilling machine, where a computer and peripherals are connected to operate the disclosed drilling tool changer apparatus.

The drilling machine 100 further includes a control system 155, which is operatively coupled to the power pack 105. The associated implements operatively connected to the power pack 105 and the control system 155 are described in more detail below and suggested only schematically in FIG. 1. FIG. 2 shows schematically the control system 155 operatively associated with the example drilling machine which here includes the disclosed drilling tool changer apparatus. The control system 155 comprises generally a computer 160 that is typically a programmable digital computer, further comprising a read-only memory, a non-transitory computer readable storage medium for storing instructions executable by a processor (such as a random-access memory), a central-processing unit or processor, and a hard drive or flash memory or the like for further storage of programs and data, as well as input and output ports. FIG. 2 shows the example control system 155 operatively connecting the computer 160 to a visual display 165 for an operator, and a control input interface 170, such as a joystick, or touch screen, or both. In this disclosure, the term "computer" may be used broadly to refer to both a programmable digital computer as just described, the software executed by the computer, and relevant peripheral devices connected to a computer, as well as networks of computers. One industrial example of a computer 160 suitable for controlling the operations of actuators in a tracked vehicle is the Rig Control System (RCS) provided by Epiroc Drilling Solutions, LLC. The computer 160 connects by means of a bus 115, which may be a wired or wireless network, to the various sensors and actuators shown in FIG. 2 (and in some implementations, others).

The control system 155 includes one or more control inputs, which can either be adjusted by the operator in the operator's cab 140 or remotely from a remote location for manual control, or the operator can select a control input that initiates a semi-automatic or automatic control method. The manual, semi-automatic or automatic input controls may be employed for controlling the operation of the tower 110, including its tilt angle, and also the operations of the drilling tool changer assembly 190, described below, which is a component of the drilling tool changer apparatus.

Figure 3:
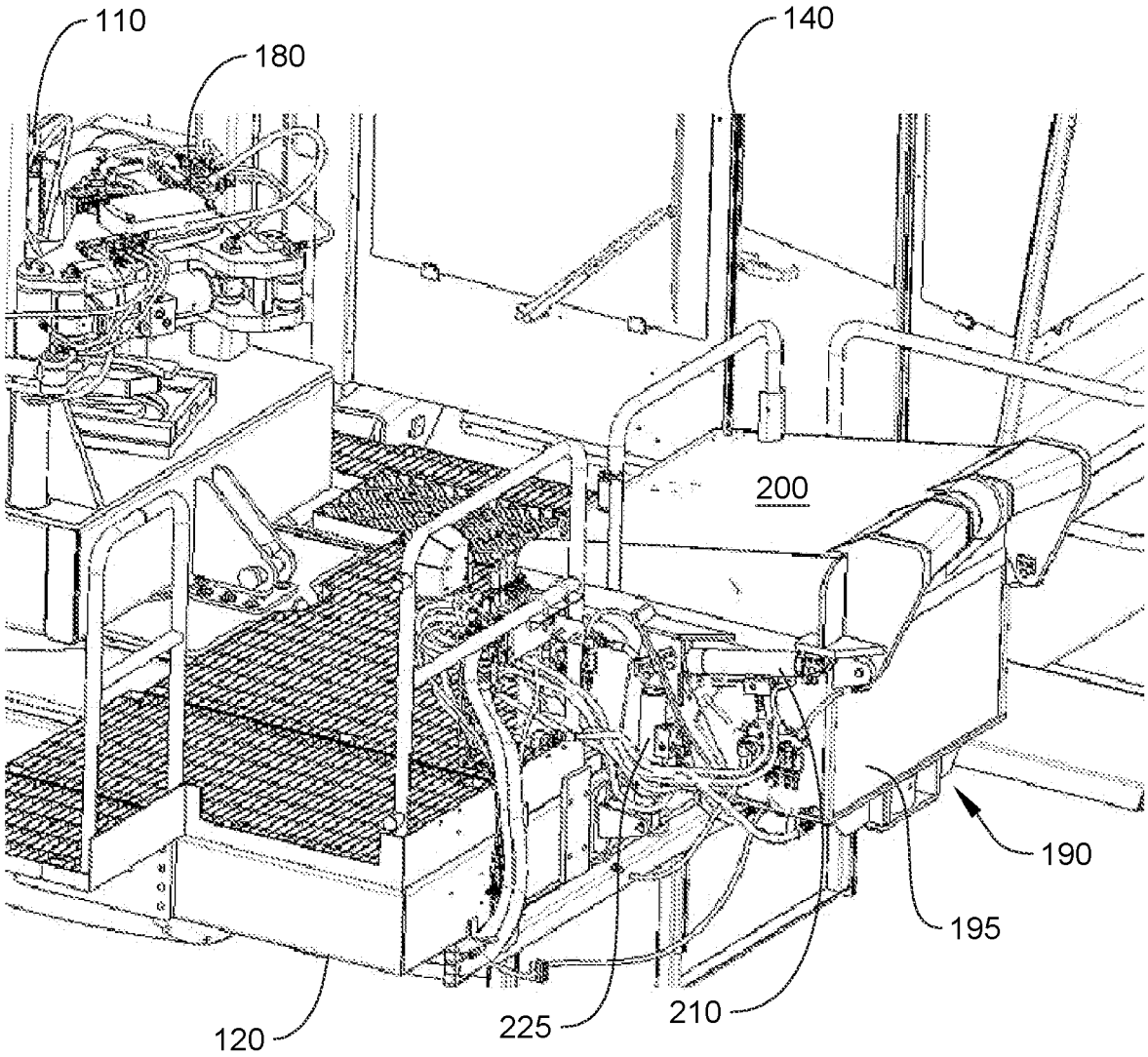
FIG. 3 is a perspective view of the rig platform showing a drilling tool changer assembly positioned near the breakout area of the tower.

FIG. 3 is a perspective view of the rig platform showing the drilling tool changer assembly 190 positioned near the break-out area of the tower. Referring to FIG. 3, we see a drilling tool changer assembly 190, comprising an enclosure 195 for the carousel assembly 230 (see FIGS. 7 and 8). The drilling tool changer assembly 190 is disposed on the rig platform 120 and mounted by a hinge 220 so as to rotate upward from the rear (to the left in FIG. 3) when urged upward by changer actuators 225. FIG. 3 also shows breakout tool 180 adjacent to the base of the tower 110, and the operator's cab 140 that would typically be situated adjacent to tower 110 on the drilling rig 100. The enclosure 195 has a lid 200 that can be opened by action of one or more lid actuators 210, which may be hydraulic or electric motors or the like. The lid 200 is not required, but is desirable to keep dirt and foreign objects from falling into the drilling tool changer assembly 190.

It is advantageous that the disclosed drilling tool changer assembly 190 is not located over the opening in the drill deck 120, where it could interfere with breakout operations, and further, is not located on or connected to the tower 110, where it would add extra weight and complicate balancing the tower 110.

Figure 4:
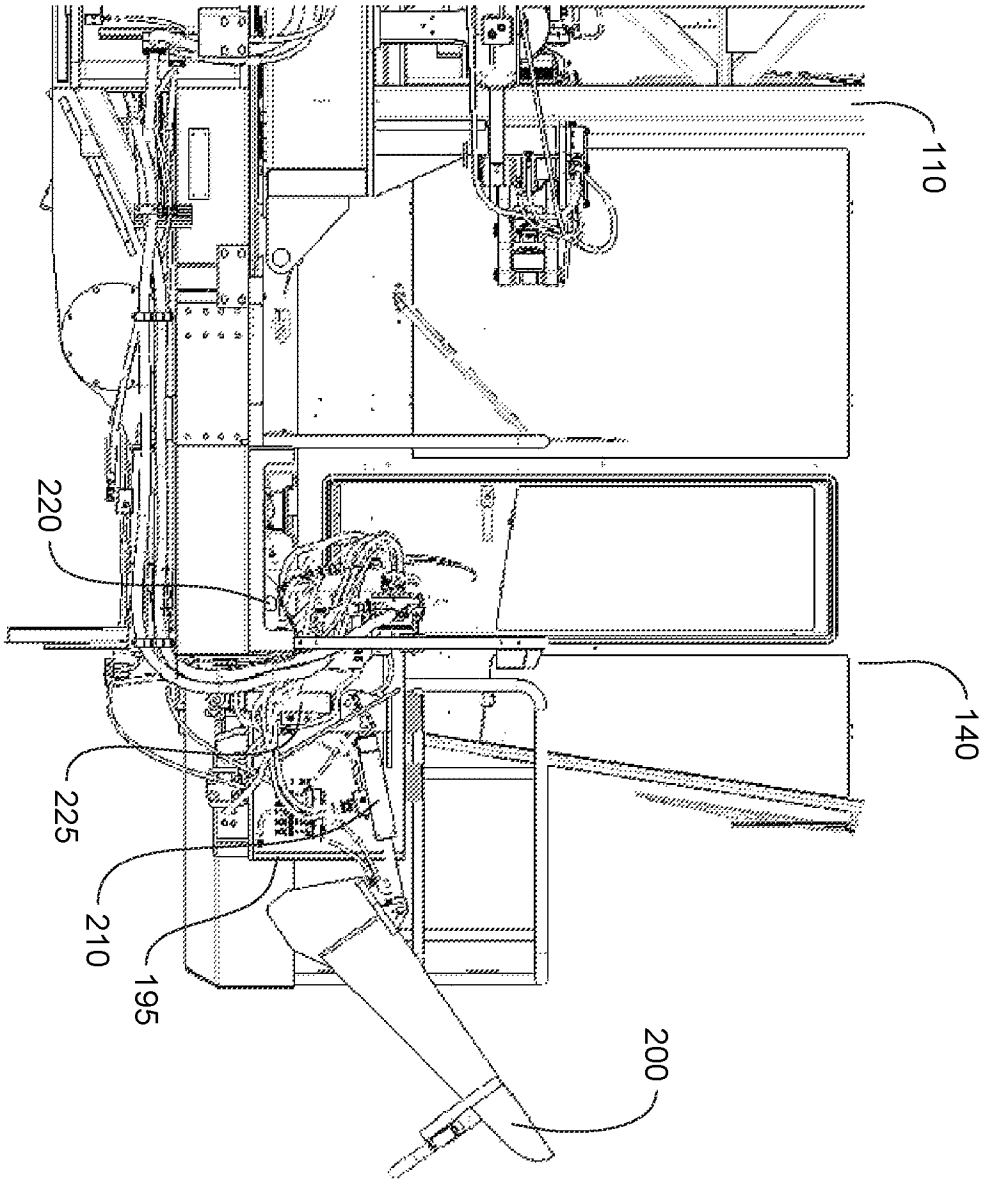
FIG. 4 is a side view of the structure in FIG. 3 showing the lid to the drilling tool changer assembly enclosure opened.
Figure 5:
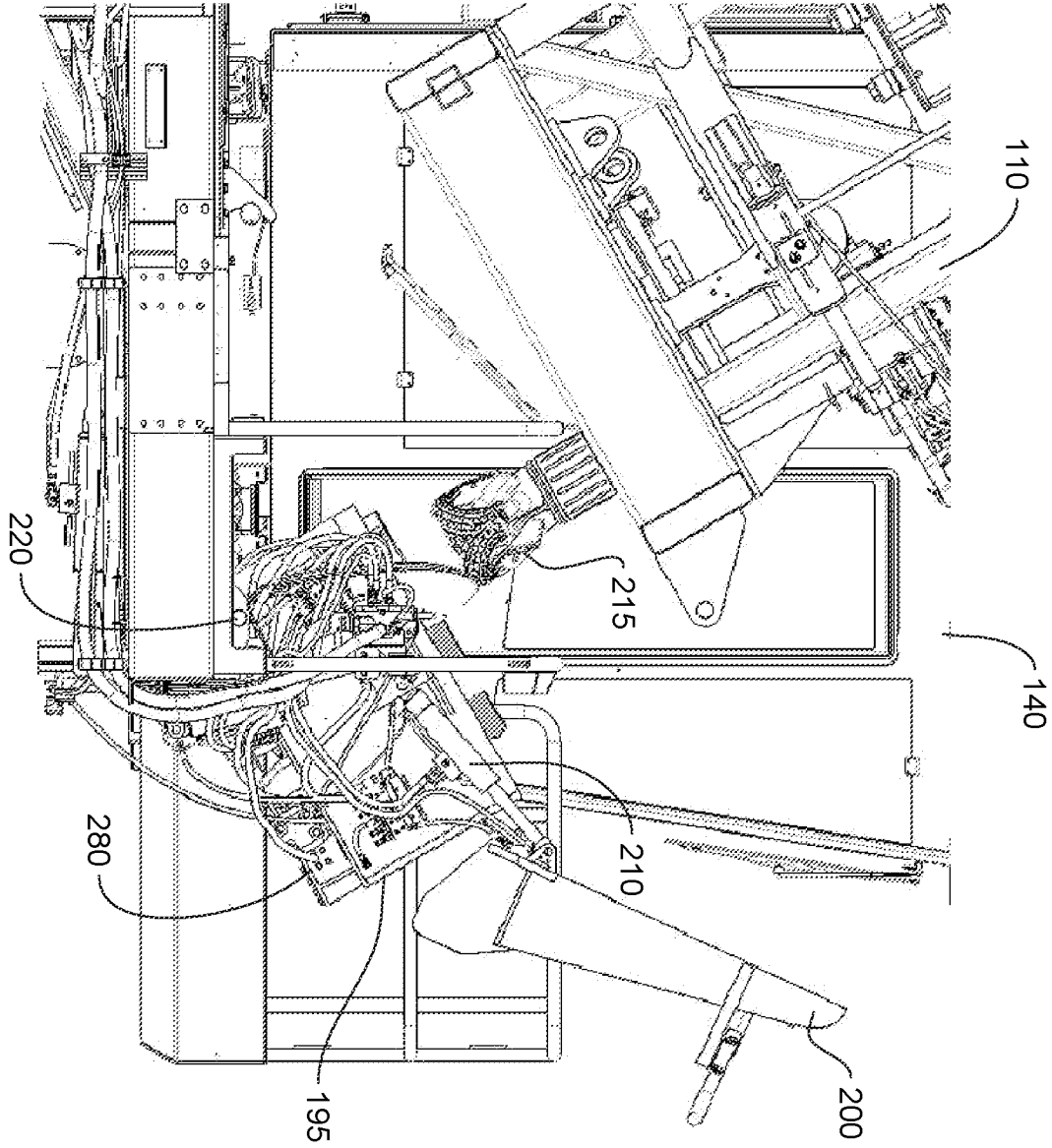
FIG. 5 is a side view of the structure of FIG. 4, showing the drilling tool changer assembly tilted to engage with a drill pipe in the tower; the drill pipe having a drilling tool attached.
Figure 6:
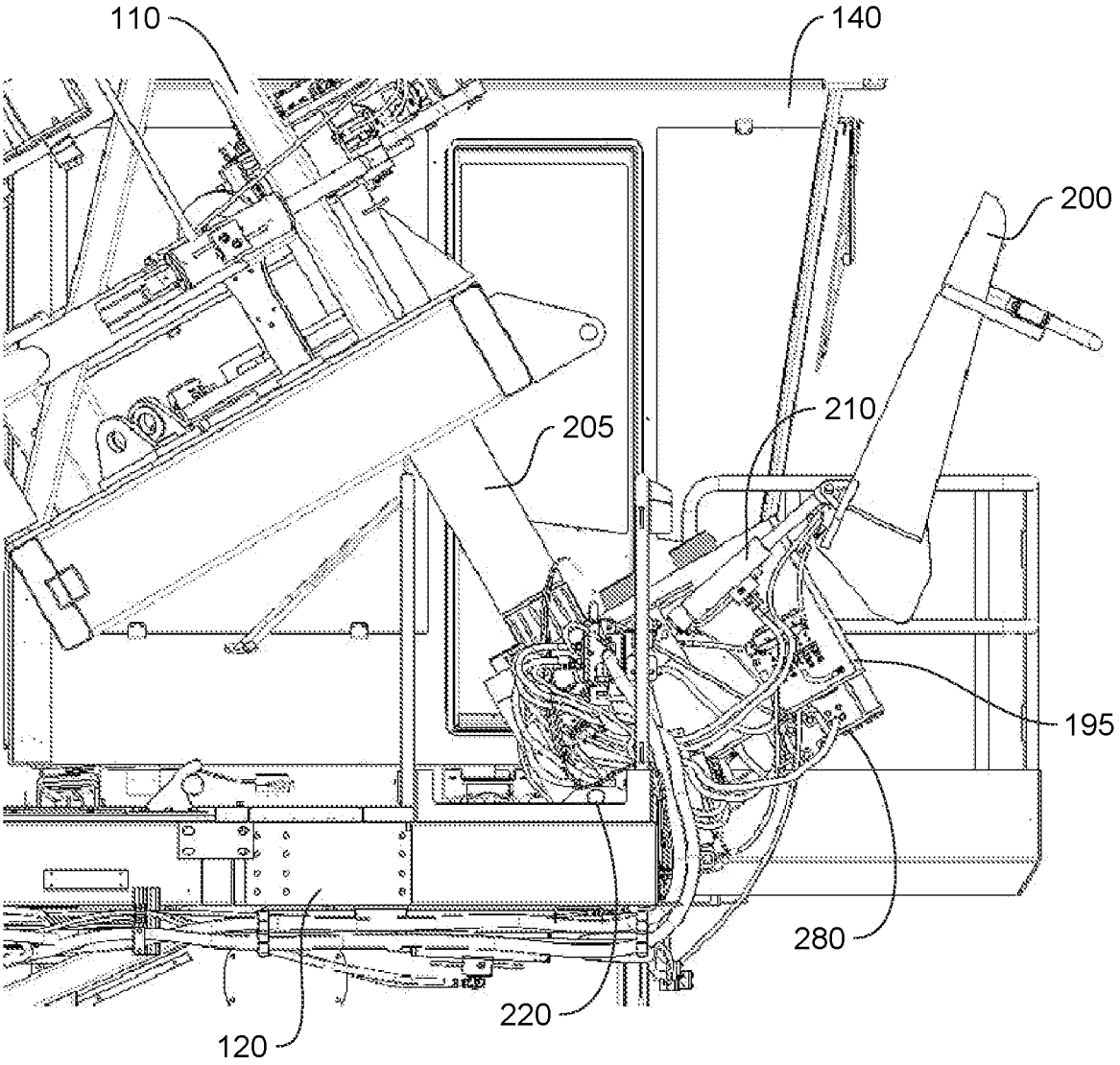
FIG. 6 is a side view of the structure of FIG. 4, showing the drilling tool changer assembly tilted and engaged with a drill pipe for removal or addition of a drilling tool to the drill pipe.
Figure 7:
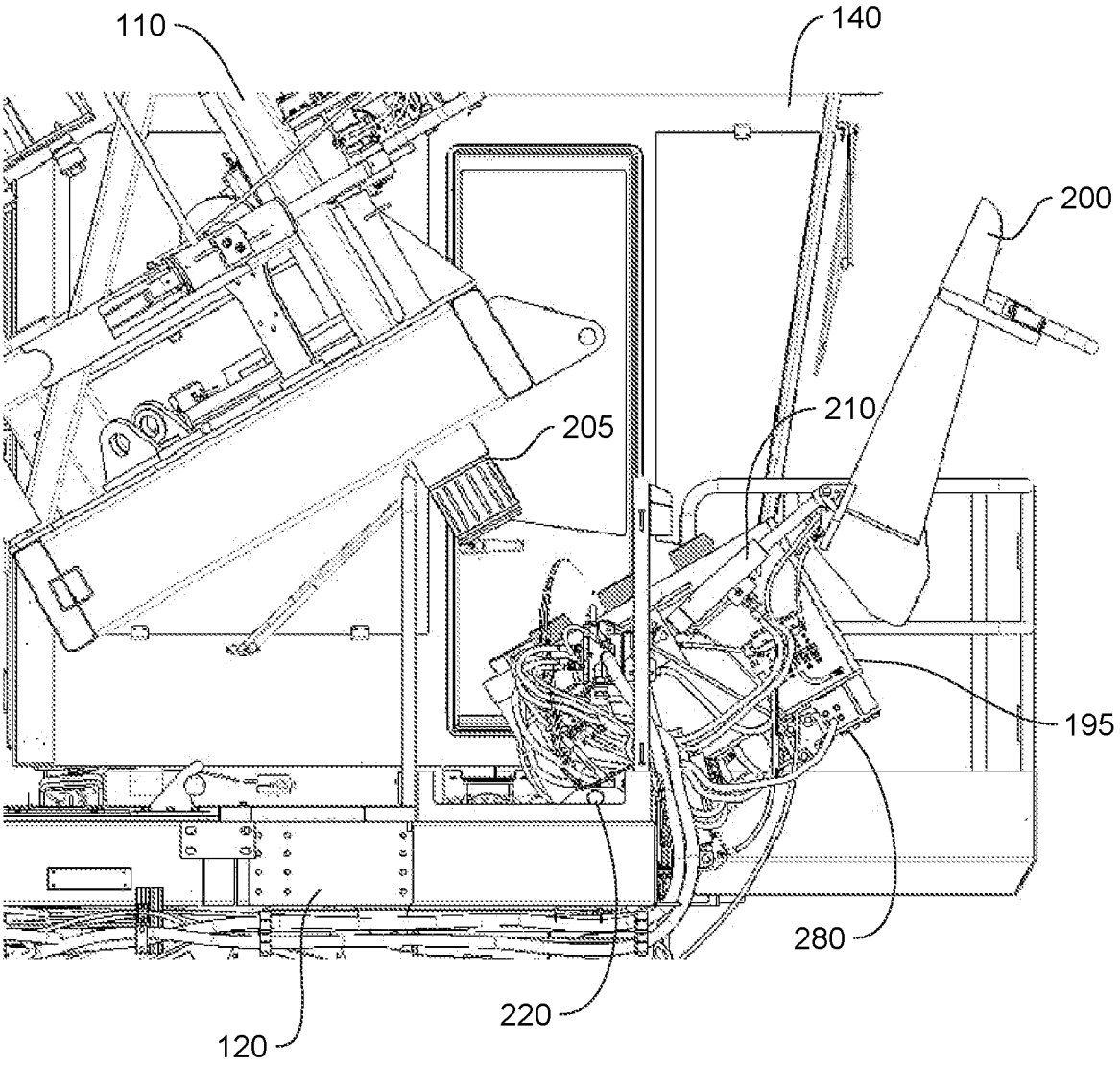
FIG. 7 is a side view of the structure of FIG. 4 showing the drilling tool changer assembly tilted and a drill pipe withdrawn from the assembly after removal of a drilling tool from the drill pipe.

FIG. 4 shows a side view of the structures of FIG. 3, where the lid 200 of the carousel enclosure 195 is opened. In FIG. 5, the drilling tool changer assembly 190, with the lid 200 of the carousel enclosure 195 opened, is tilted forward on the hinge 220 by action of actuators 225, thus moving from a storage position as shown in FIGS. 3 and 4, to an exchange position, as shown in FIGS. 5 and 6. FIG. 6 shows the tilted drilling tool changer assembly 190 receiving a drilling tool 215 from the drill string 150 held by the now-tilted tower 110, where the drilling tool changer assembly 190 is tilted at an angle to substantially match the tilt of the tower 110. FIG. 7 shows a drill string 150 after a drilling tool 215 has been removed and placed in the drilling tool changer assembly 190. FIGS. 5-7 could also illustrate the opposite operation, where a drilling tool 215 is attached to the drill string 150. FIGS. 5-7 show an actuator or motor 280 for rotating the carousel assembly 230. (The actuator or motor 280 may include a gearbox.) The apparatus and procedures for the change-out or replacement of the drilling tool 215 are described in more detail below.

Drilling Tool Changer Carousel Assembly

Figure 8:
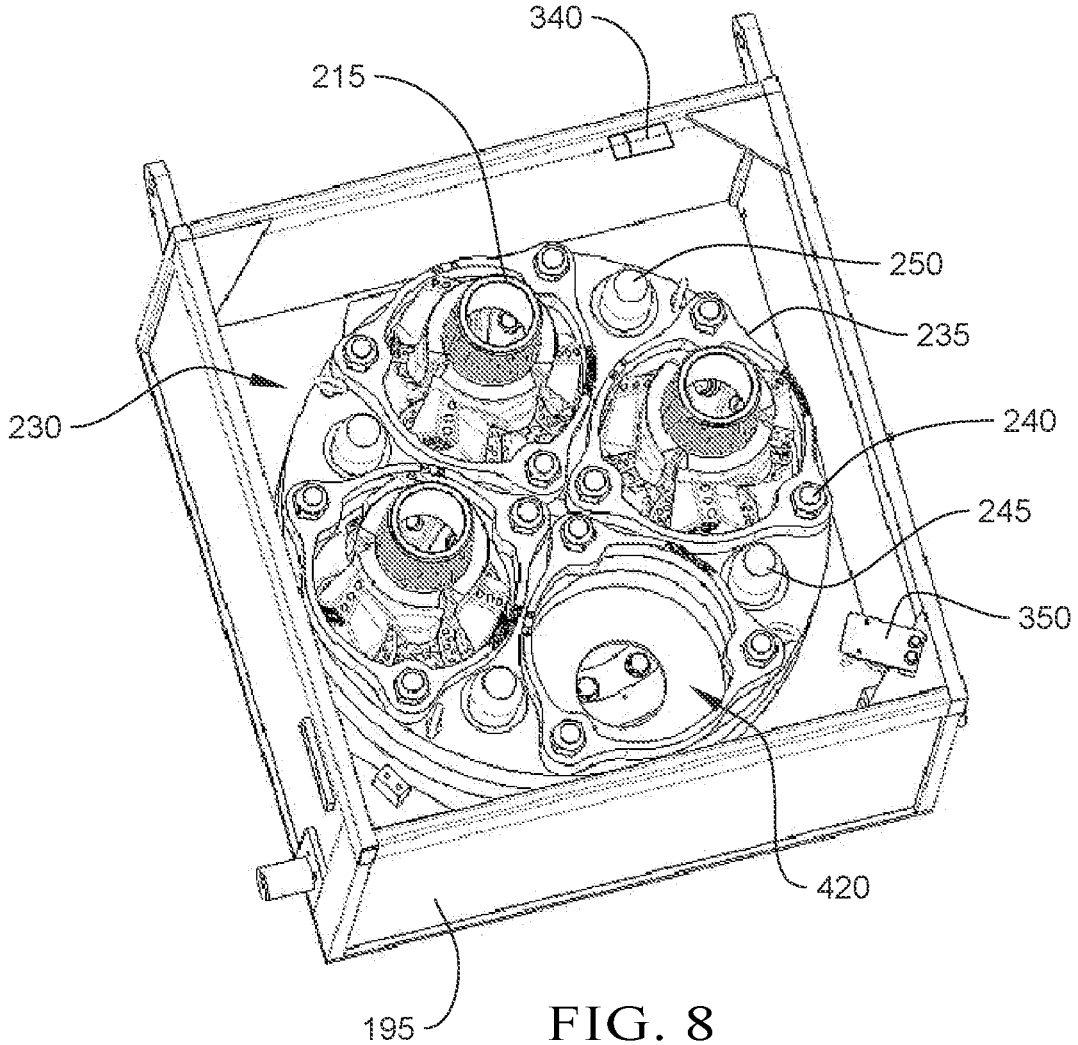
FIG. 8 is a perspective view of the first implementation of the carousel of a drilling tool changer assembly including an enclosure, with bit adaptors shown holding a plurality of drilling tools.

FIG. 8 is a perspective view of an implementation of the rotatable carousel assembly 230 of a drilling tool changer assembly 190, situated in an enclosure 195, with bit adaptors 235 shown holding a plurality of drilling tools 215. The rotatable carousel assembly 230 is removable from the drilling tool changer assembly 190 and replaceable therein, as will be described. The rotatable carousel assembly 230 has a plurality of receptacles, called here bit adaptors 235, for receiving drilling tools 215. The rotatable carousel assembly 230 is selectively rotatable, in either direction, via a motor 280, to bring a selected drilling tool 215 into coaxial alignment with the drill string 150 when the drilling tool changer assembly 190 supporting the rotatable carousel assembly 230 is moved into the exchange position as shown in FIGS. 5-7. FIG. 8 also shows an empty bit adaptor 235 in a pre-determined angular position 420 of the rotatable carousel assembly 230, where a used drilling tool 215 may be deposited after removal from the drill string 150. Alternatively, this pre-determined angular position 420 could be the current position of a drilling tool 215 held in the bit adaptor 235, to be attached to the drill string 150. In either case, the rotatable carousel assembly 230 will be rotated to bring the relevant bit adaptor 235 into the correct pre-determined angular position 420 for the pick-up or drop-off of a drilling tool 215 as determined by an operator or the control system 155.

The rotatable carousel assembly 230 has at least one alignment pin 245 situated on the alignment plate 255 below a carousel plate 285, which alignment pin 245 passes through a slot, notch, or hole 290 in the carousel plate 285, so that the carousel plate 285 can be held on the alignment plate 255 in a fixed angular position within the rotatable carousel assembly 230. The carousel plate 285 of this implementation further comprises at least one off-center alignment hole 295, comprising a slot, notch or hole, mating with an off-center alignment pin 250, for re-aligning the rotatable carousel assembly 230 in the same angular position on the alignment plate 255 after the rotatable carousel assembly 230 is removed from the drilling tool changer assembly 190 and replaced in the drilling tool changer assembly 190. In this way the rig operator, or an automatic process in a control system 155, can know which drilling tool 215 is in which bit adaptor 235 in the rotatable carousel assembly 230. The feature allows the operator or control system 155 to confirm or select the correct drilling tool 215 for the desired drilling task, because in general, drilling tools 215 may be of different sizes, or types, or even have different conditions of wear, and it is highly advantageous to know without manual inspection which drilling tool 215 is in which position in the rotatable carousel assembly 230, so that drilling operations are not delayed after a change-out of drilling tools 215.

The reader should note that the alignment pin or pins 245, and the off-center alignment pin 250 are shown schematically in the figures, and represent, in general, an indexing feature. These may be any sort of finger, rod, or lug that can engage slots, notches or holes in the carousel plate 285 to maintain the same in a given angular position in the rotatable carousel assembly 230, and thus the terms "alignment pin" or "off-center alignment pin" should be construed broadly according to this indexing function. In particular, in some implementations therefore, alignment pins 245 or off-center alignment pin 250 do not pierce the carousel plate 285 completely in order to engage it.

In some implementations, the rotatable carousel assembly 230 may optionally be a first rotatable carousel assembly 230, and the rotatable carousel assembly 230 replaced in the drilling tool changer assembly 190 may be a second rotatable carousel assembly 230, the second rotatable carousel 230 having possibly replaced or exchanged drilling tools 215.

Figure 9A:
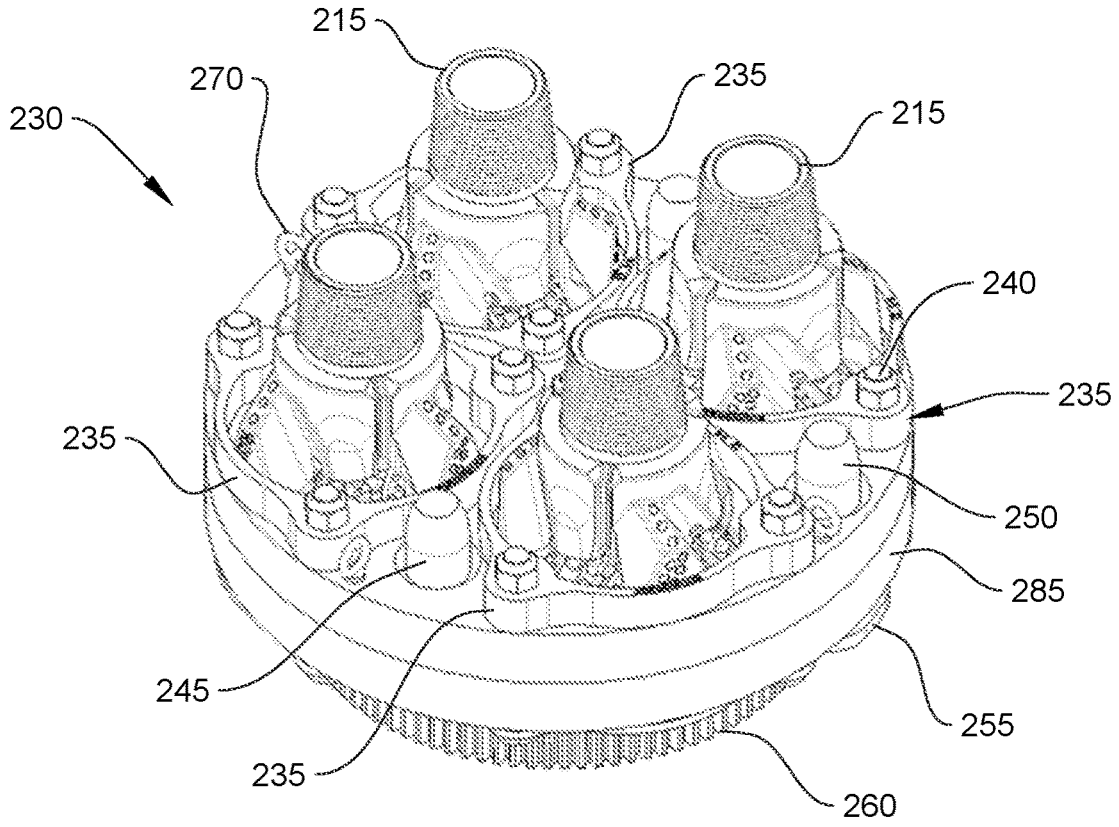
FIG. 9A is the assembled carousel shown holding drill bits.

FIG. 9A shows examples of drilling tools 215 resting in the bit adaptors 235. Each bit adaptor 235 is connected to a carousel plate 285. FIG. 9A shows alignment holes 290 in the carousel plate 285 for selectively receiving an alignment pin 245, and also shows at least one off-center alignment hole 295 and off-center alignment pin 250, to allow indexing of the carousel plate 285. The carousel plate 285 may be a single plate, or constructed of two plates bolted together by bolts or retaining pins 240, for ease of manufacturing.

FIG. 9A shows the rotatable carousel assembly 230 as described in above, but including the alignment plate 255 that supports the alignment pins 245 and off-center alignment pin or pins 250. (Generally, only one off-center pin 250 would be required for alignment, but more than one could be provided, and reference here to an "alignment pin" includes one or more.) The carousel plate 285 and the bit adaptors 235 are preferably bolted together with bolts 240. FIG. 9A shows the alignment plate 255 supporting the alignment pins 245 and off-center alignment pin 250, rotatable by a bull gear 260. As shown in FIG. 9, the carousel plate 285 is removably supported by the alignment plate 255, and the alignment pins 245 and off-center alignment pin 250 thus pass through holes or slots 290 in the carousel plate 285. One of the holes or slots is an off-center alignment hole 295, so that the carousel plate 285 (and thus the bit adaptors 235) can only be indexed to and replaced in one position on the alignment plate 255.

Figure 9B:
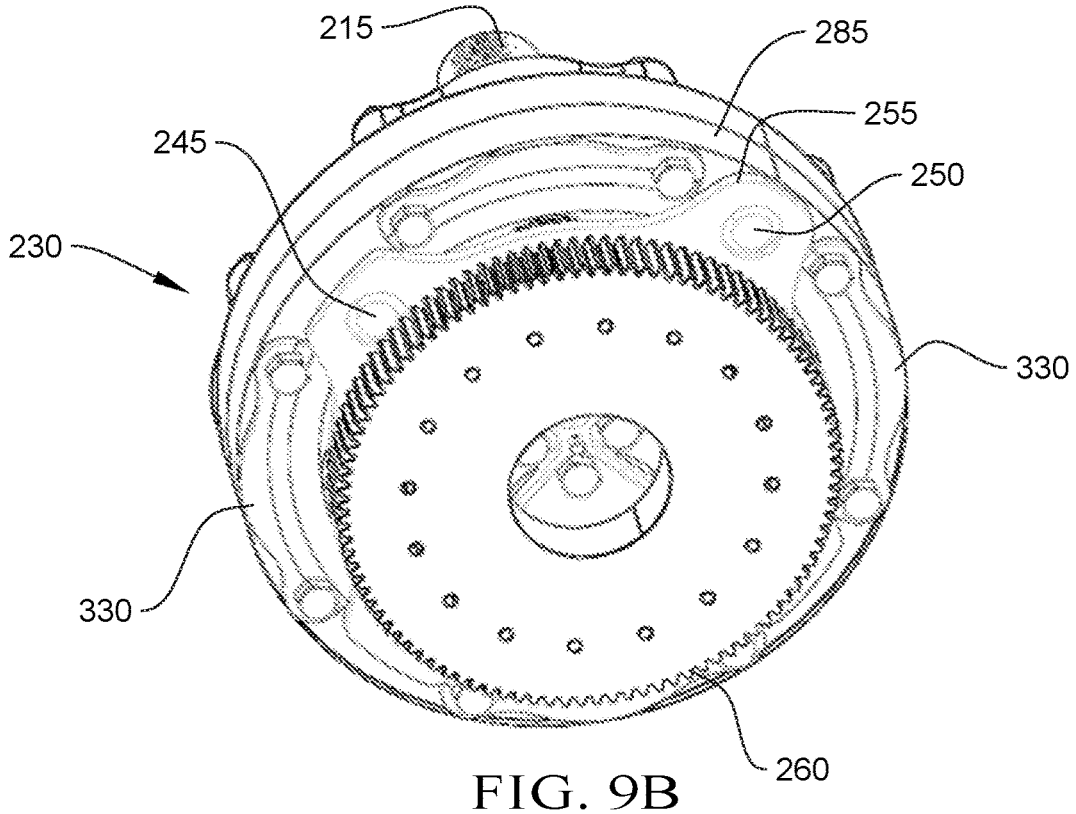
FIG. 9B is a perspective view of an implementation of the rotatable carousel assembly viewed from the rear.

FIG. 9B is a perspective view of this implementation of the rotatable carousel assembly 230 viewed from the rear or bottom of the assembly depicted in FIG. 9A. FIG. 9B shows how the carousel plate 285 is supported on the alignment plate 255, and how the alignment plate 255 is fastened to a bull gear 260, which bull gear 260 rotates the alignment plate 255, and thus the carousel plate 285, when rotation is imparted to the bull gear 260 by an actuator, such as a motor 280 and pinion gear (not shown in FIG. 9). The rotation imparted may be in either direction, under command of an operator or an automatic process in a control system 155, to index the rotatable carousel assembly 230 to the desired position, as explained below.

Figure 10A:
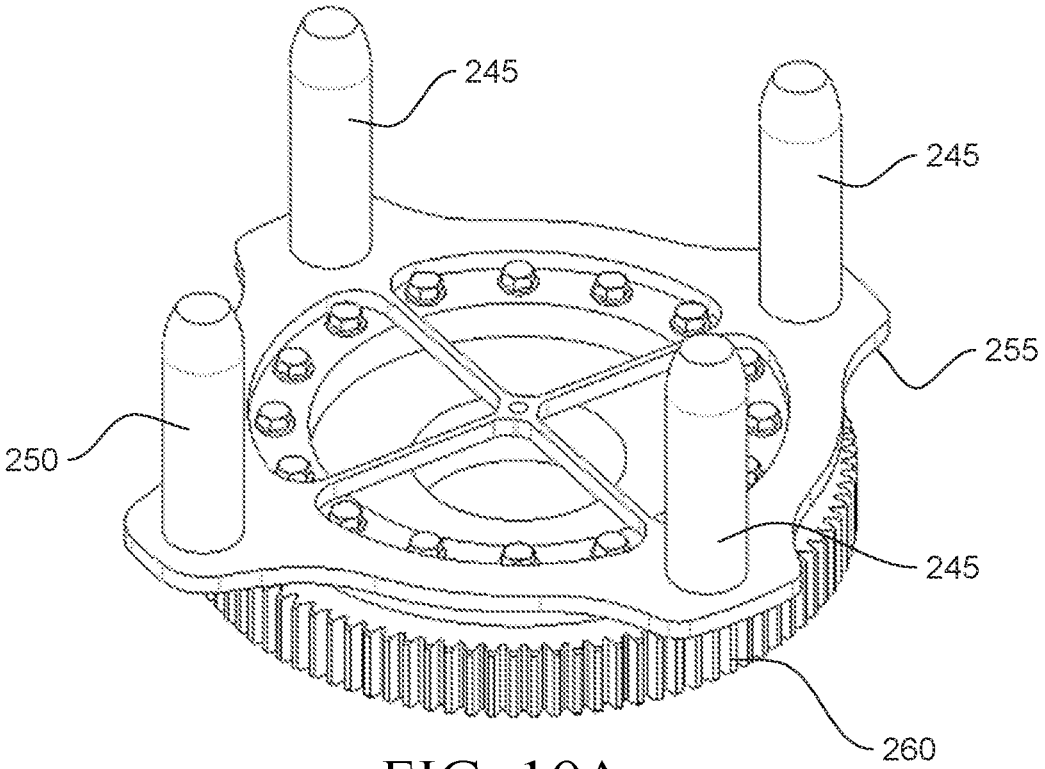
FIG. 10A is a perspective view of the alignment plate of the rotatable carousel of the drilling tool changer assembly, showing alignment pin to be received by the carousel plate.
Figure 10B:
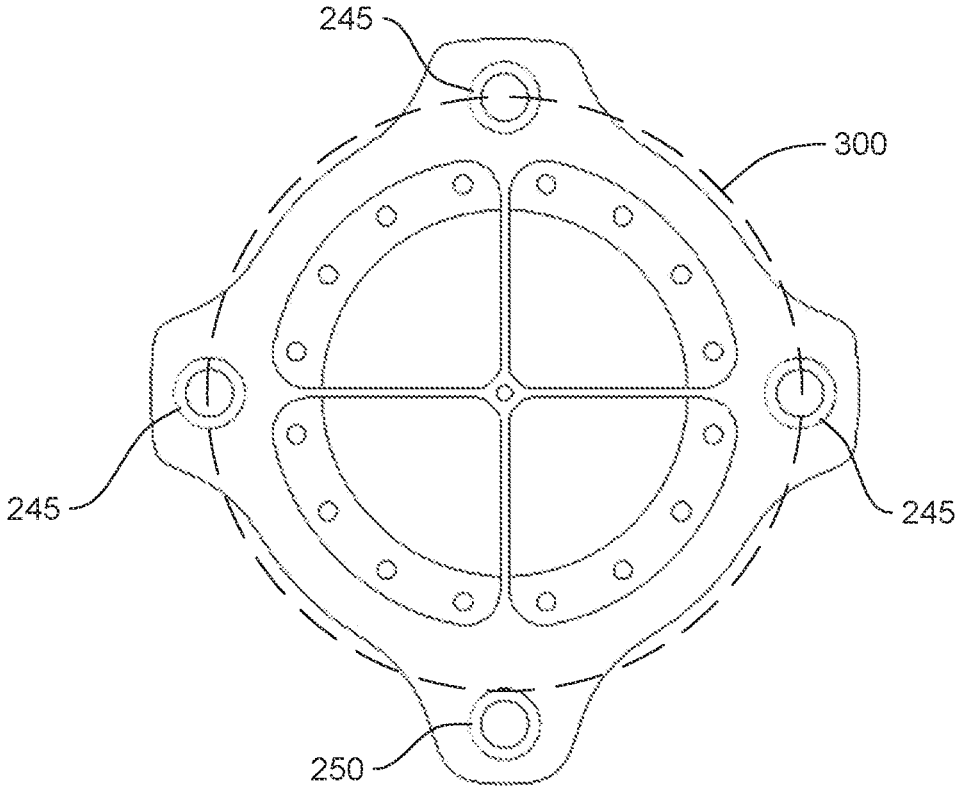
FIG. 10B is a plan view of the structure of FIG. 10A, showing the off-center location of one alignment pin.

FIG. 10A show a perspective view of the alignment plate 255 supported by the bull gear 260. The alignment plate 255 supports a plurality of alignment pins 245, and at least one off-center alignment pin 250. As described above with reference to FIG. 9, the carousel plate 285 is supported by the alignment plate 255, where alignment holes 290 (and off-center alignment hole 295) in the carousel plate 285 receive, respectively, alignment pins 245 and the at-least one off-center alignment pin 250. This structure is shown in plan view in FIG. 10B, where the circumference 300 of a circle on the radius of the alignment pins 245 is shown, illustrating the off-center location of the at least one off-center alignment pin 250, as well as the respective alignment holes 290 and off-center hole 295 in the carousel plate.

Figure 11:
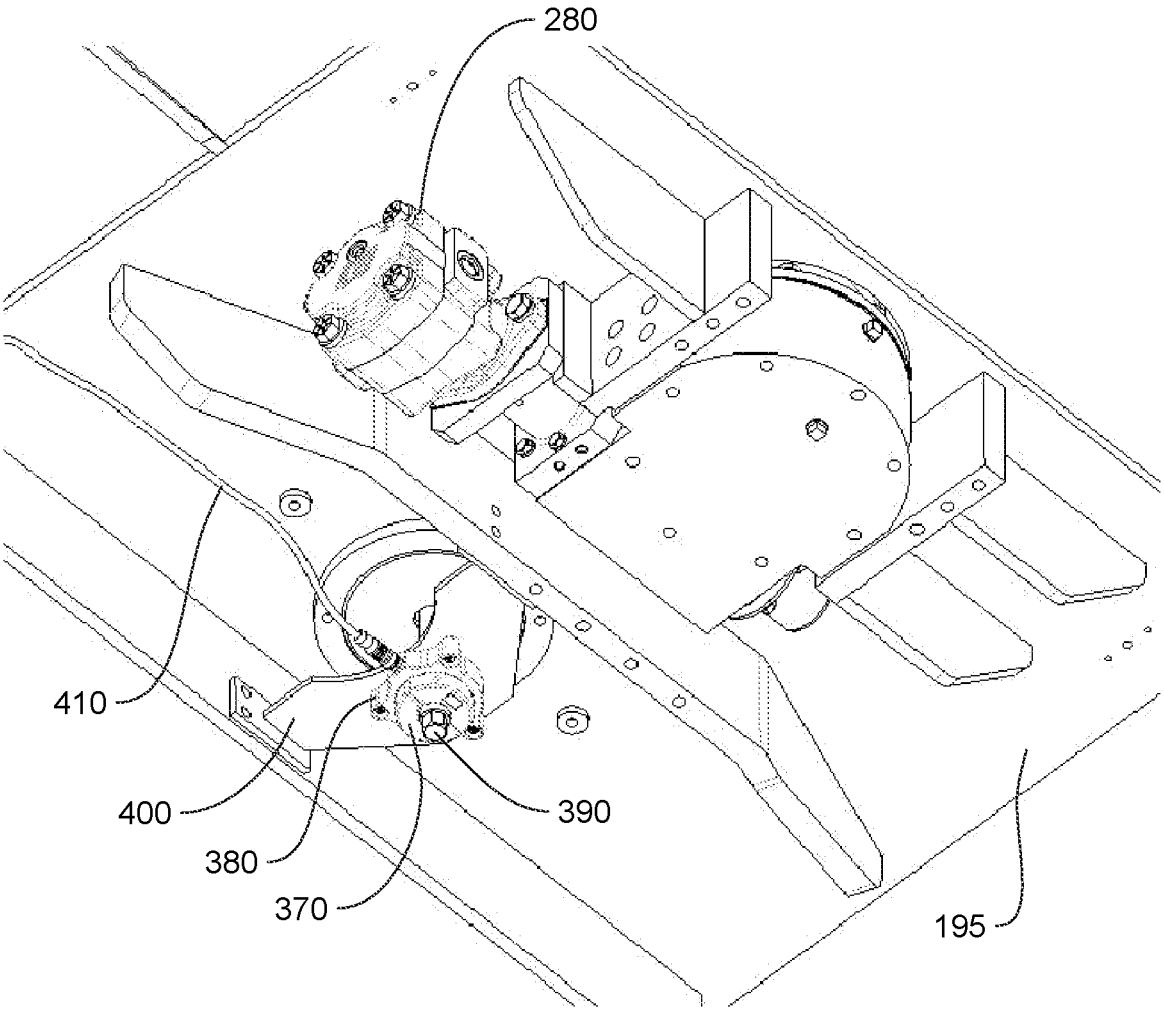
FIG. 11 is a perspective view of an implementation of the drilling tool changer assembly, viewed from the underside of its enclosure and illustrating a sensor arrangement for detecting the angular position of the rotatable carousel.

FIG. 11 illustrates an implementation of a sensor arrangement for detecting the angular position of the rotatable carousel assembly 230. A magnet 370 or equivalent is connected to a pin or shaft 390, which pin or shaft 390 is connected to the alignment plate 255 and compelled to rotate therewith. A sensor 380 detecting the position of the magnet 370 is fixed to a bracket 400 or other convenient structure that is fixed to the enclosure 195 of the drilling tool changer assembly 190, so that as the alignment plate 255 rotates by action of the motor 280, the change in output from the sensor 380 corresponds to the angular position of the alignment plate 255, and thus the angular position of the rotatable carousel assembly 230, which is rotated by action of the alignment plate 255. Because the rotatable carousel assembly 230 only fits the alignment plate 255 in one predetermined position, the output of the sensor 380 uniquely reports the angular position of the rotatable carousel assembly 230, which output is preferably communicated to the control system 155 by means of a connector 410, which can be a cable or wireless connection. A suitable magnetic sensor of this type would be the SMART Position Sensor configuration, manufactured by Honeywell International, Inc., or equivalent.

Figure 12A:
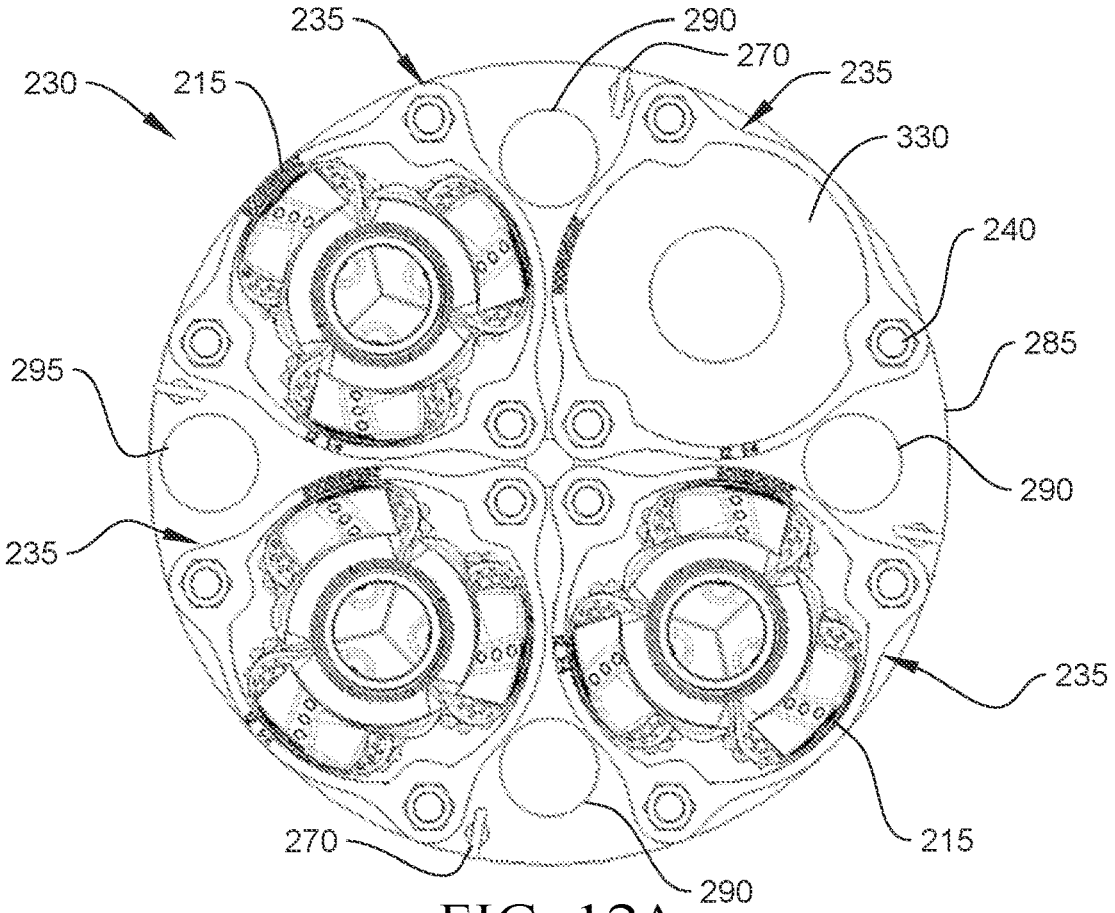
FIG. 12A is a plan view of the rotatable carousel of the drilling tool changer assembly.
Figure 12B:
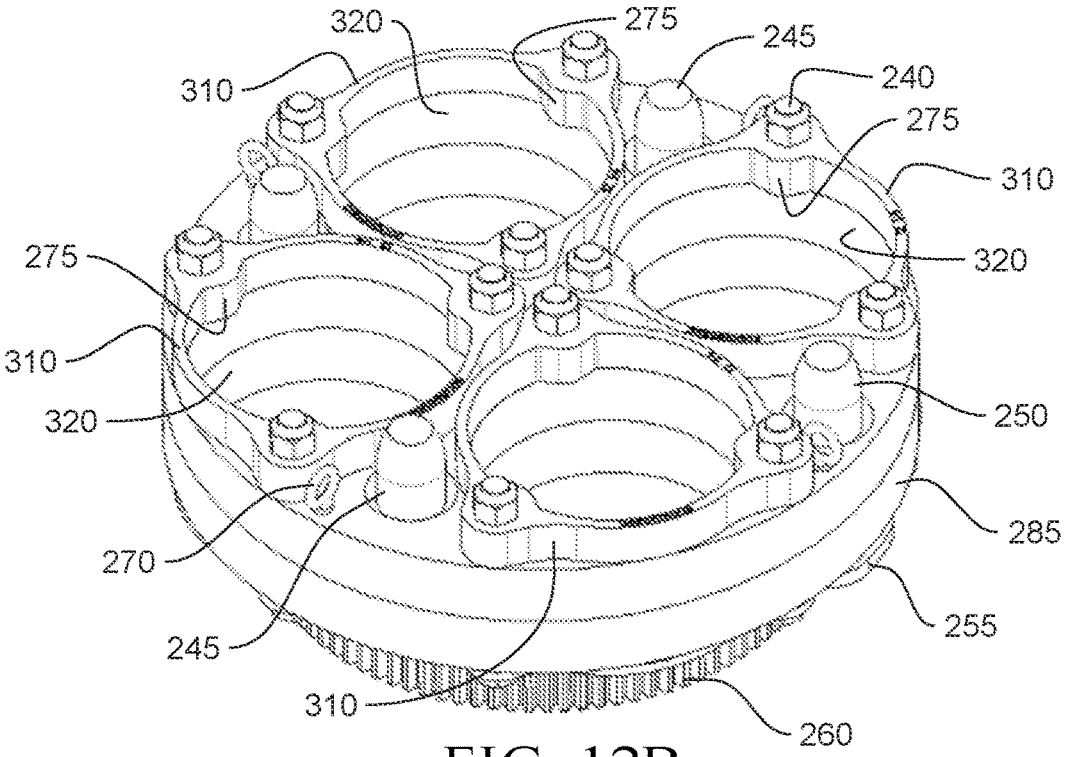
FIG. 12B is a perspective view of the carousel without drilling tools in the holders for the same.

FIG. 12 is a more detailed view of the carousel assembly 230 of the drilling tool changer assembly 190, FIG. 12A being a plan view and FIG. 12B being a perspective view of the same. In FIG. 12A, three bit adaptors 235 are occupied by drilling tools 215, and one bit adaptor 235 is empty. (The reader should note that the number of bit adaptors 235 in a carousel assembly may be more or fewer than the four shown.) In FIG. 12B, for clarity, all the bit adaptors 235 are shown as empty.

FIGS. 12A and 12B show a carousel plate 285, which may be one integral plate, or, for convenience of construction, two or more plates fastened together, with bolts, such as the retaining pins or bolts 240 shown. The carousel plate 285 supports bit adaptors 235 (described in more detail below), for receiving drilling tools 215. The carousel plate 285 has holes 290 for receiving alignment pins 245, and at least one off-center hole 295 for receiving an at least one off-center alignment pin 250. In this way, a particular type of drilling tool 215 located in a particular bit adaptor 235, and be replaced in the same position in the carousel assembly 230, if the carousel assembly 230 is removed and replaced in the drilling tool changer assembly 190.

Further referring to FIGS. 12A and 12B, the figures show lifting rings 270, where by a lifting apparatus, such as a crane, can attach to and lift out the carousel assembly 230 for replacement of drilling tools 215 in the bit adaptors 235. The bit adaptors 235 are shown fastened to the carousel plate 285 by retaining pins or bolts 240. As illustrated below, each bit adaptor 235 further comprises a breaker plate 310 and a bit holder 320. Alternatively, the breaker plate 310 may be fastened to a bit holder plate 330 that may be removable. The breaker plate 310 of the bit adaptors 235 comprises nubs 275 in its inner circumference to hold the drilling tool 215 and resist the torque of the drill pipe 205 when the drill pipe 205 is rotated by the break-out tool mechanism 180, as a drilling tool 215 is added to or removed from the drill pipe 205. Therefore, no special sub or supplemental adaptor to the drilling tool 215 is required for the breakout operations.

Figure 13A:
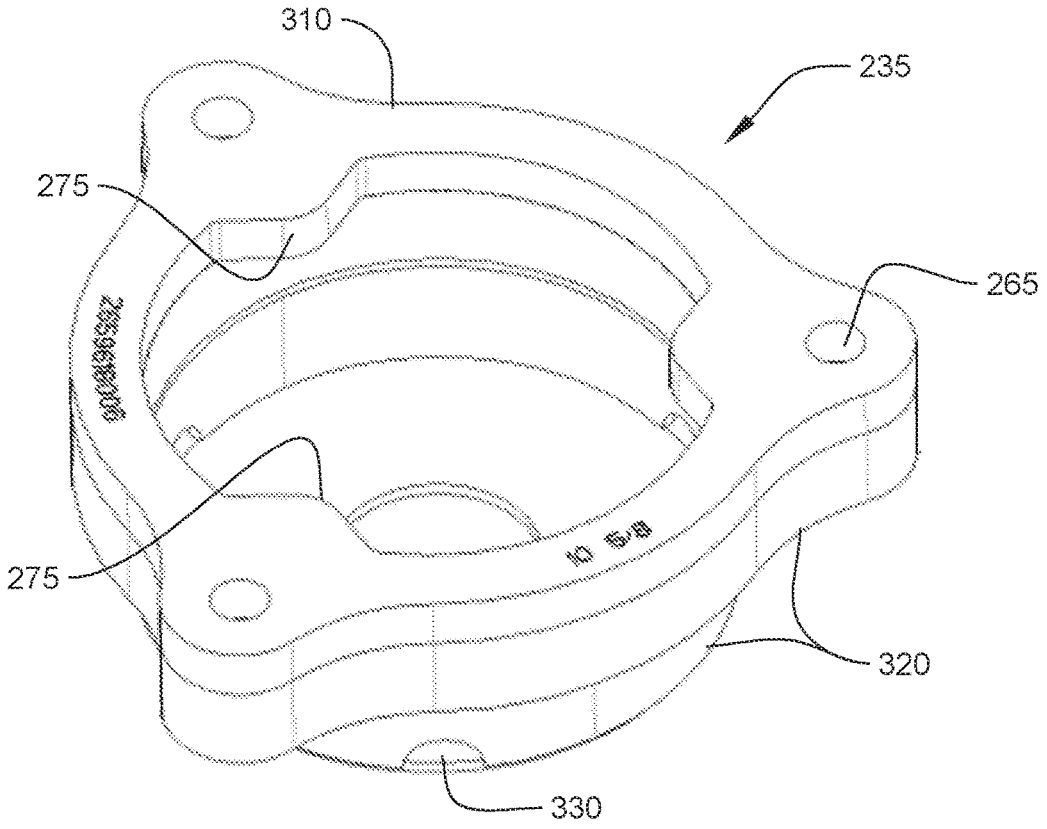
FIG. 13A is an adaptor having a welded bottom plate and FIG. 13B is an adaptor having a removable bottom plate.
Figure 13B:
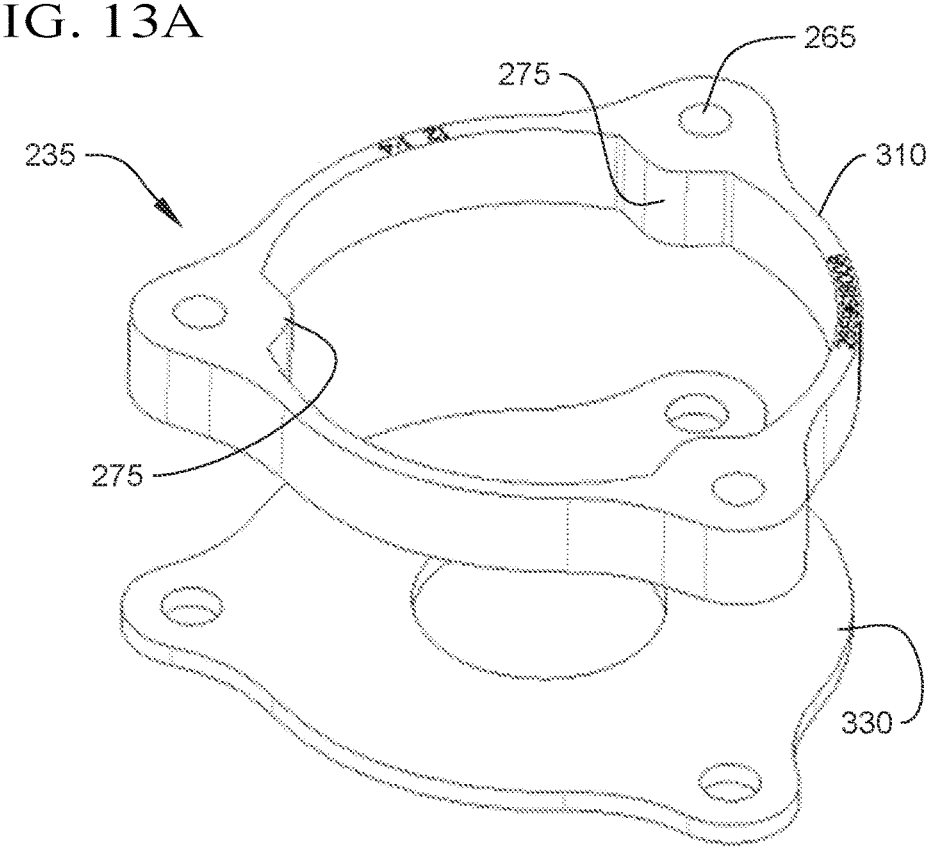

FIG. 13 shows more detail of bit adaptor 235 of the drilling tool changer assembly 190. In FIG. 13A, an implementation has a breaker plate 310 with nubs 275, where the nubs 275 are sized to grasp a drilling tool 215 of a predetermined size and restrain its movement against the torque of the break-out operation. In FIG. 13A, the bit holder 320 and the bit holder plate 330 are alternatively welded together to form an integral unit. Mounting holes 265 are provided for mounting the bit adaptor 235 to the carousel plate 285. In the implementation of FIG. 13B, the breaker plate 310 is connected to a bit holder plate 330, where the bit holder plate 330 supports a drilling tool inserted into the bit adaptor 235. The implementation of FIG. 13A, providing a more shallow receptacle, is adapted to support and hold smaller drilling tools 215 than the implementation of FIG. 13B. In either implementation, the bit adaptor functions to provide storage for the drilling tool 215 in the carousel assembly 230, while also holding the drilling tool 215 firmly against the torque of the break-out operation.

Figure 14A:
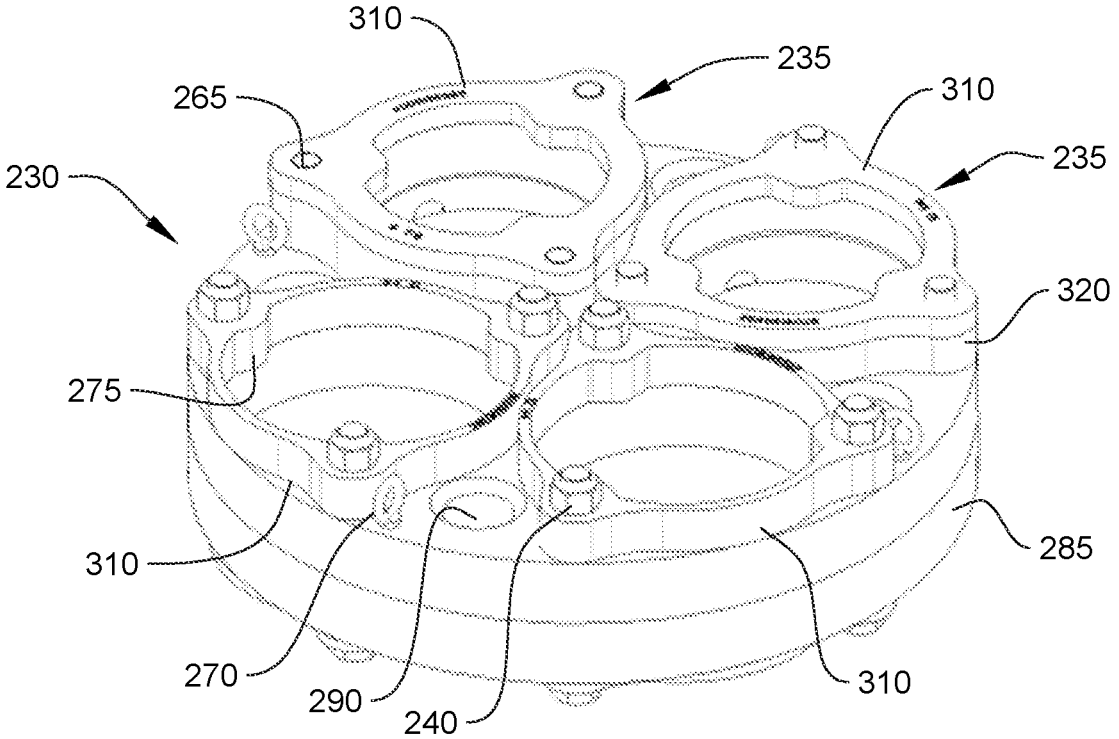
FIG. 14A shows empty bit holders on the carousel of the drilling tool changer assembly.
Figure 14B:
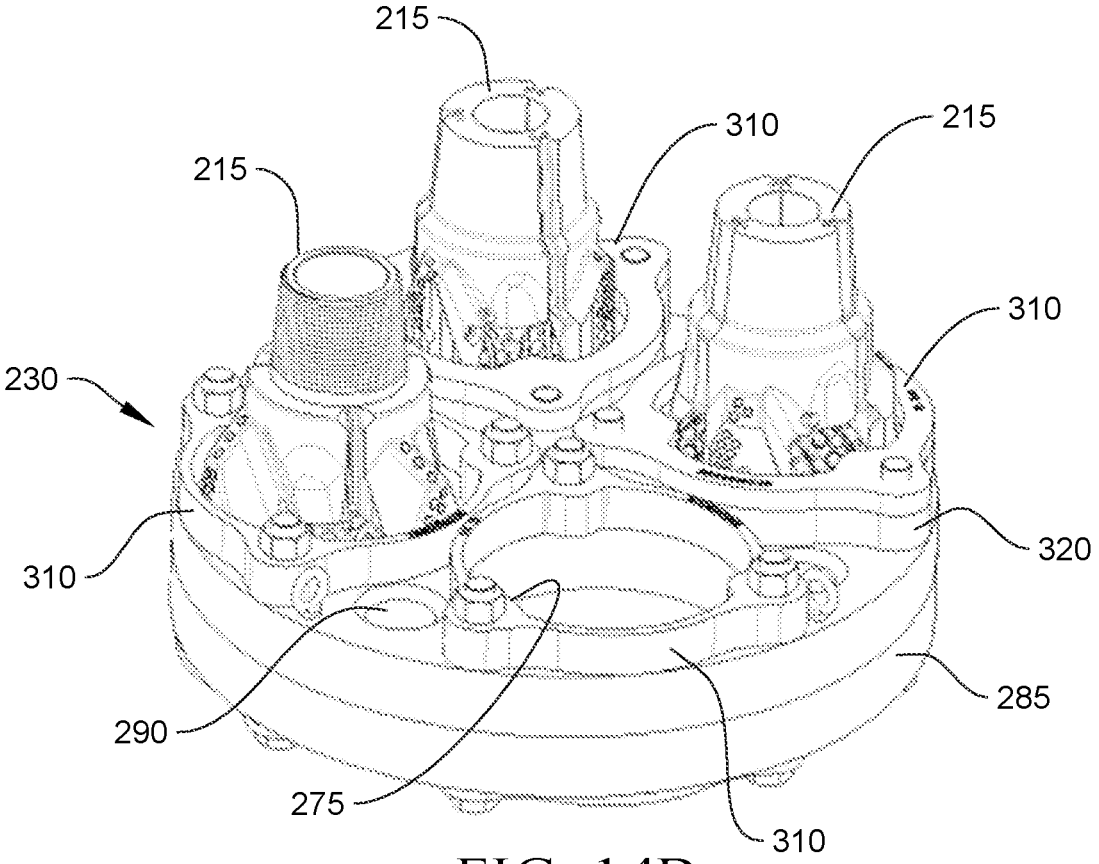
FIG. 14B shows a plurality of bits or drilling tools disposed in bit adaptors of possibly varying sizes on a carousel plate.
Figure 15A:
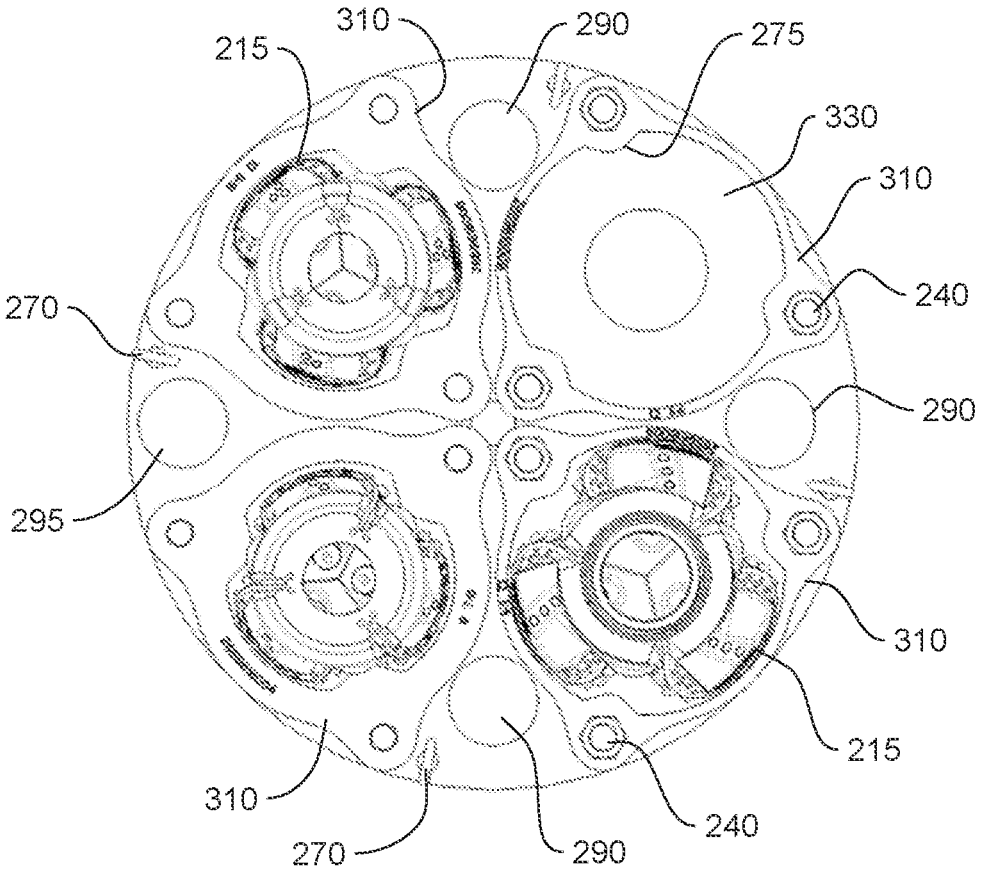
FIG. 15A is a plan view of the implementation of the drilling tool changer assembly where the bit adaptors are of various sizes.
Figure 15B:
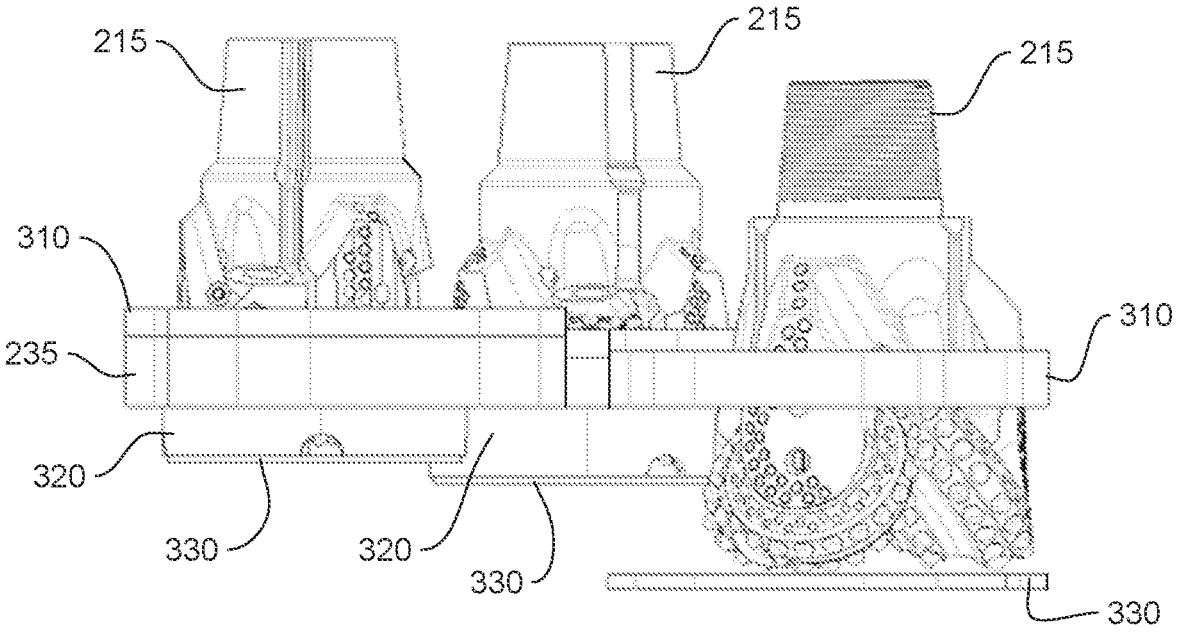
FIG. 15B is a side cut-away view of bit adaptors of various sizes on a carousel.

FIGS. 14A and 14B show implementations of the drilling tool changer assembly 190 where the bit adaptors 235 situated in the carousel assembly 230 are sized to receive drilling tools 215 of differing sizes, both in diameter or in depth, or both dimensions. FIG. 15A is a plan view of such an implementation. FIG. 15B is a side view omitting depiction of the carousel plate 285 for clarity, and showing only the exemplary bit adaptors 235 of varying sizes. In FIG. 15B, the rightmost bit adaptor 235 depicted has a bit holder plate 330, but alternatively lacks a bit holder 320.

Detection of Drilling Tools in Changer Assembly

It is advantageous for an operator or an automatic process to detect if a bit or drilling tool 215 is present in the rotatable carousel assembly 230, so that no attempt will be made to engage with the drill pipe 205 if no bit is present. Also, it is advantageous that an operator or automatic process can detect which type of bit or drilling tool 215 is actually present in a particular bit adaptor 235. To that end, implementations can be provided with these capabilities. Radio-frequency identification (RFID) technology, for example, is known in the art. FIG. 8 illustrates an RFID sensor 340 situated at some convenient location in the enclosure 195 of the rotatable carousel assembly 230. The RFID sensor 340 can read a corresponding RFID tag (not shown) on a drilling tool 215 and transmit this identification to an operator or automatic process in the control system 155, where it may be stored for further reference or use in the automatic process. For example, an automatic process could select the desired size and type of drilling tool 215 for particular rock strata or drilling conditions. Equivalently, electromagnetic sensors could be employed, such as near-field communications devices operating on principles generally within RFID technology, as is known in the art. In other implementations, the RFID sensor 340 could be a plurality of RFID sensors 340, where each is associated with a particular bit adaptor 235.

Further, FIG. 8 shows an ultrasonic detector 350, which provides the capability of detecting whether or not a drilling tool 215 is present in a particular bit adaptor 235 of the rotatable carousel assembly 230. In the case of both the RFID sensor 340 and the ultrasonic detector 350, the relevant index or angular position of the rotatable carousel assembly 230 (as known by the means described in connection with FIG. 11 above) can be correlated with the identification returned from the RFID sensor 340, or with the signal from the ultrasonic detector 350 to provide this information to an operator or to an automatic process in the control system 155, where it may be stored for future reference or use in an automatic process. Equivalents in other implementations could be a radar sensor to detect presence of a bit 215, or a switch.

Semi-Automatic or Automatic Control of Drilling Tool Changing System

In some implementations, the control system 155 of the present disclosure may be selectively operated to perform semi-automatic or automatic control methods for changing out a drilling tool 215. As compared to manual methods, the semi-automatic and automatic methods enable greater precision for alignment and placement of components and holding tight tolerances.

Various implementations of the semi-automatic and automatic methods may comprise: providing a control system with a drilling control computer, such as control system 155 with drilling control computer 160; the drilling control computer having a user interface for an operator, such as visual display 165, and a control input interface 170 for the operator, such as a joystick, or touch screen, or both; operatively connecting the drilling control computer to the drilling tool changer apparatus, such as drilling tool changer assembly 190; and, programming the control computer with control instructions including an automatic drilling tool exchange operation to the drilling control computer, wherein the automatic drilling tool exchange operation includes some or all of the following steps, as illustrated in FIGS. 16-22.

Basic steps include raising and lowering the drilling machine tower, such as tower 110, to a specified angle, such as the exchange position shown in FIGS. 5-7; opening and closing the lid 200 of the carousel enclosure 195 (sometimes referred to herein as the "bit box"); raising and lowering the bit box to a specified angle, such as the exchange position shown in FIGS. 5-7; monitoring the status of the bit to determine if there is an "old", "new" or "no" bit attached to the drill string, indexing the bit carousel, such as rotatable carousel assembly 230, to a specified position; monitoring the availability of carousel cups, such as bit adaptors 235 in rotatable carousel assembly 230; feeding the rotary head, such as rotary head 145, at a specified rate and force; rotating the drill string, such as drill string 150, in order to achieve threading and unthreading, including preferably, a feature to avoid cross threading the bit by rotating CCW while feeding the drill string onto the bit.

Further, when removing an old drill bit from the drill string, basic steps of the method may include placing the old drill bit in an empty bit adaptor on the rotatable carousel with slow rotation and feed of the drill string. As the old drill bit is being received in the empty bit adaptor, and a torque threshold is met, the rotation is stopped and the bit continues to be fed into the bit adaptor. In some implementations, if the control system does not successfully put the bit into the bit adaptor, it will reattempt the process by feeding the drill string up and rotating a small number of pulse counts (degrees) before feeding back down into the bit adaptor. The control system may be programmed to reattempt this process a set number of times.

Basic steps of the method may further include: tightening all drill string joints with clockwise (CW) rotation to prevent the wrong joint from loosening; once the old bit has been placed in the bit adaptor, rotating the drill string in a CCW direction against the bit cup stops, such as the nubs 257 in bit adaptors 235, before cycling the breakout wrench, such as break-out tool mechanism 180, so that the breakout wrench has something to twist against when breaking the joint. The method may further include procedures to swing, open, and close the breakout wrench. The breakout wrench cycles one or more times in order to ensure a broken joint. Pulses of a rotation sensor may be counted to align the bit in the bit adaptor, and detect rotation after breaking the joint. Preferably, automatic dispensation of bit thread grease may be provided. Sensors, such as ultrasonic detector 350 and/or RFID sensor 340, may also be provided that detect the presence of a bit in the cup.

The figures further show procedures and commands for lifting of the drill bit and setting the status of the drill bit to the drill string. The status may be, for example, "unknown, no bit, old bit, or new bit attached to pipe." The figures depict procedures allowing simultaneous movement of the bit box, tower and carousel to reduce cycle time, and provide the ability to start the sequence from any bit to pipe status. A sensor may be used to count pipe revolutions or rotation pulses while threading to determine cross thread potential.

Alternative implementations may include automatic detection of a dull or damaged drill bit followed by automatic changing of such bit, or automatic detection of changing ground conditions followed by automatic changing to a bit that is better suited for the new ground conditions.

Figure 16:
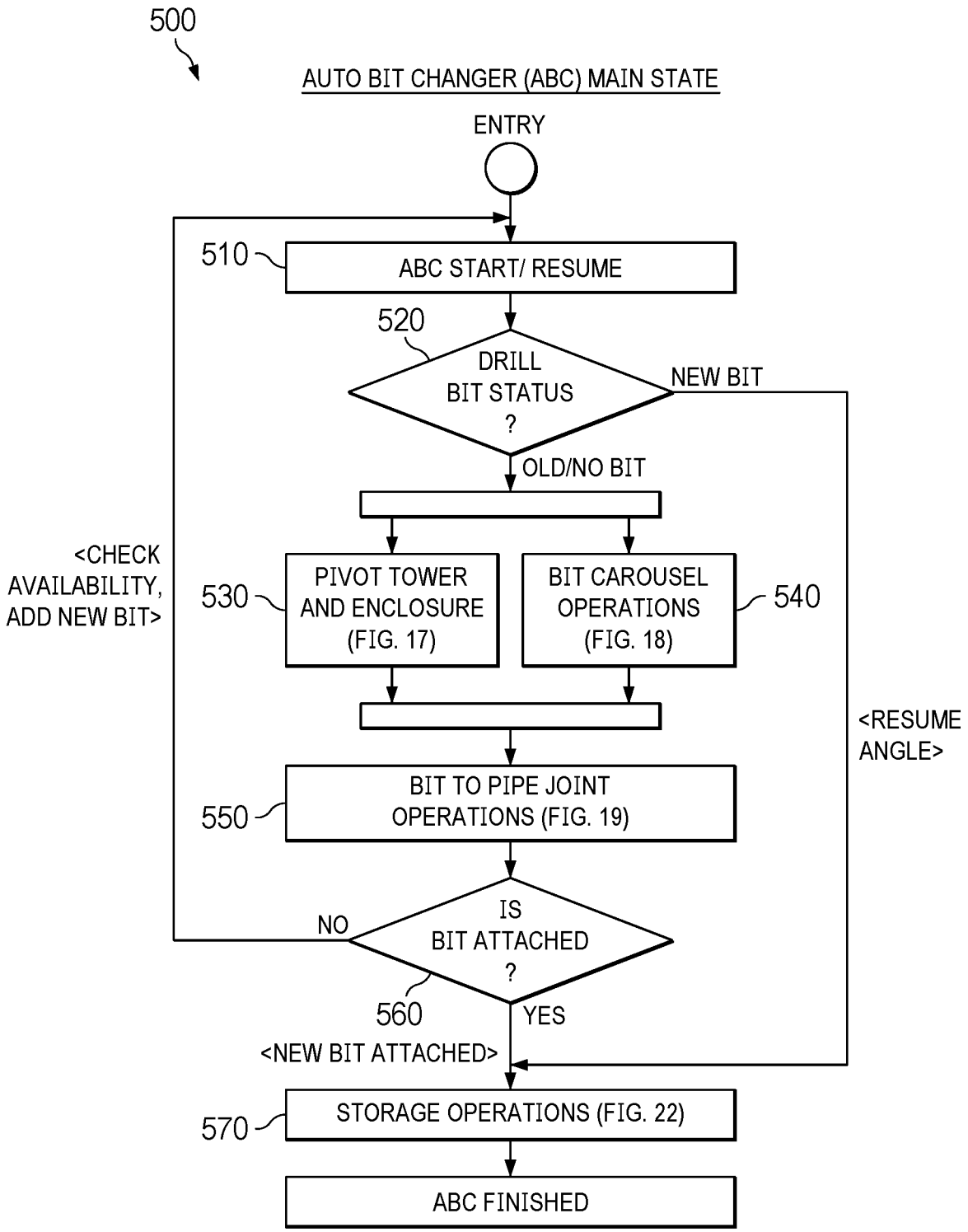
FIG. 16 is a flow chart describing overall the operations of an implementation of the semi-automatic or automatic bit changer disclosed in this application.

FIG. 16 depicts a flow chart of one implementation of a semi-automatic or automatic bit changer method 500 of the present disclosure. In the semi-automatic mode, some of the steps and/or processes of the method 500 shown in FIG. 16 are performed automatically and some are performed manually at the discretion of the operator. In the automatic mode, all of the steps and processes of the method 500 shown in FIG. 16 are performed automatically by the control system 155.

The method begins at step 510 where an operator instructs the control system 155 to either start or resume the automatic mode of operation. At step 520, the control system 155 determines the status of the drill bit currently installed on the drill string. If the drill bit status is "new", meaning the drill bit has just been added to the drill string, then the control system 155 bypasses the bit changing operation of steps 530 to 560 and sends a "resume angle" signal to return the tower and enclosure to the storage position in step 570, as will be described in more detail with respect to FIG. 22. However, if the drill bit is "old", meaning it has been used and should be changed, or if there is no drill bit currently attached to the drill string, then the control system employs the bit changing operation of steps 530 to 560.

Figure 17:
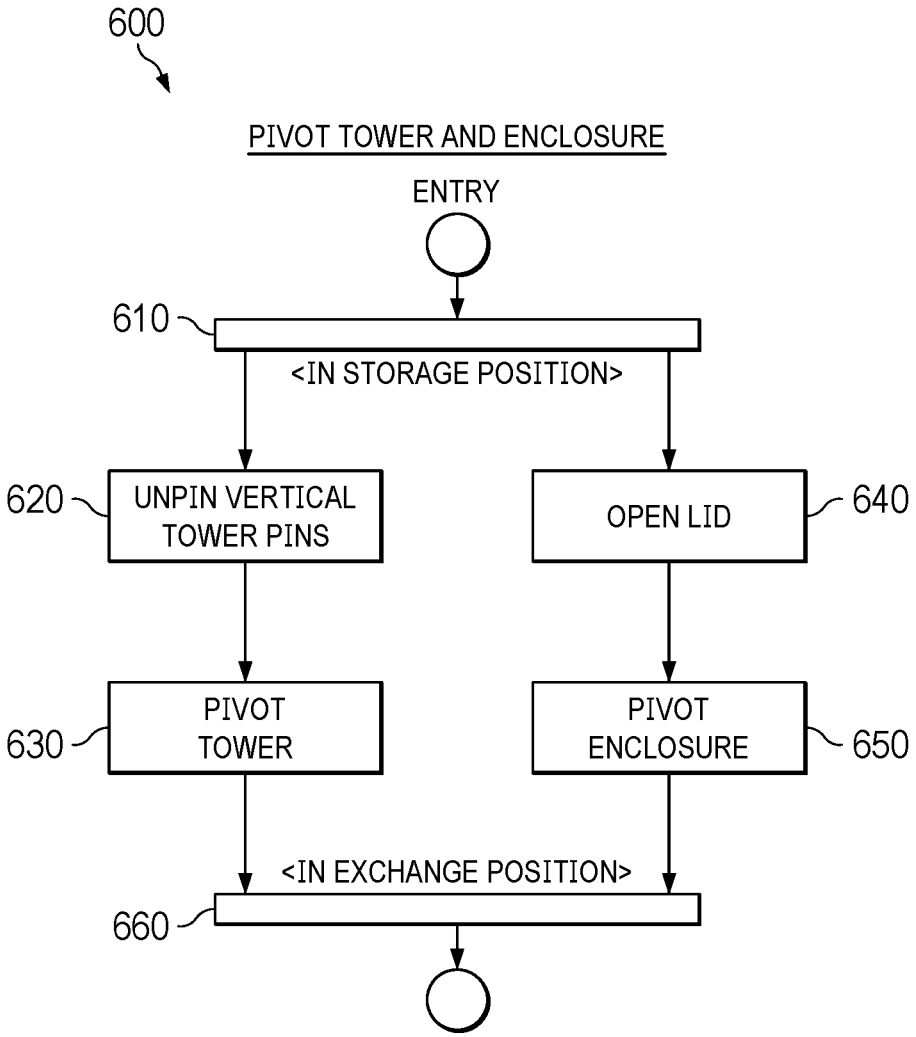
FIG. 17 is a flow chart describing the operations of the pivot tower, the enclosure for the rotatable carousel assembly, and the lid for the enclosure.
Figure 18:
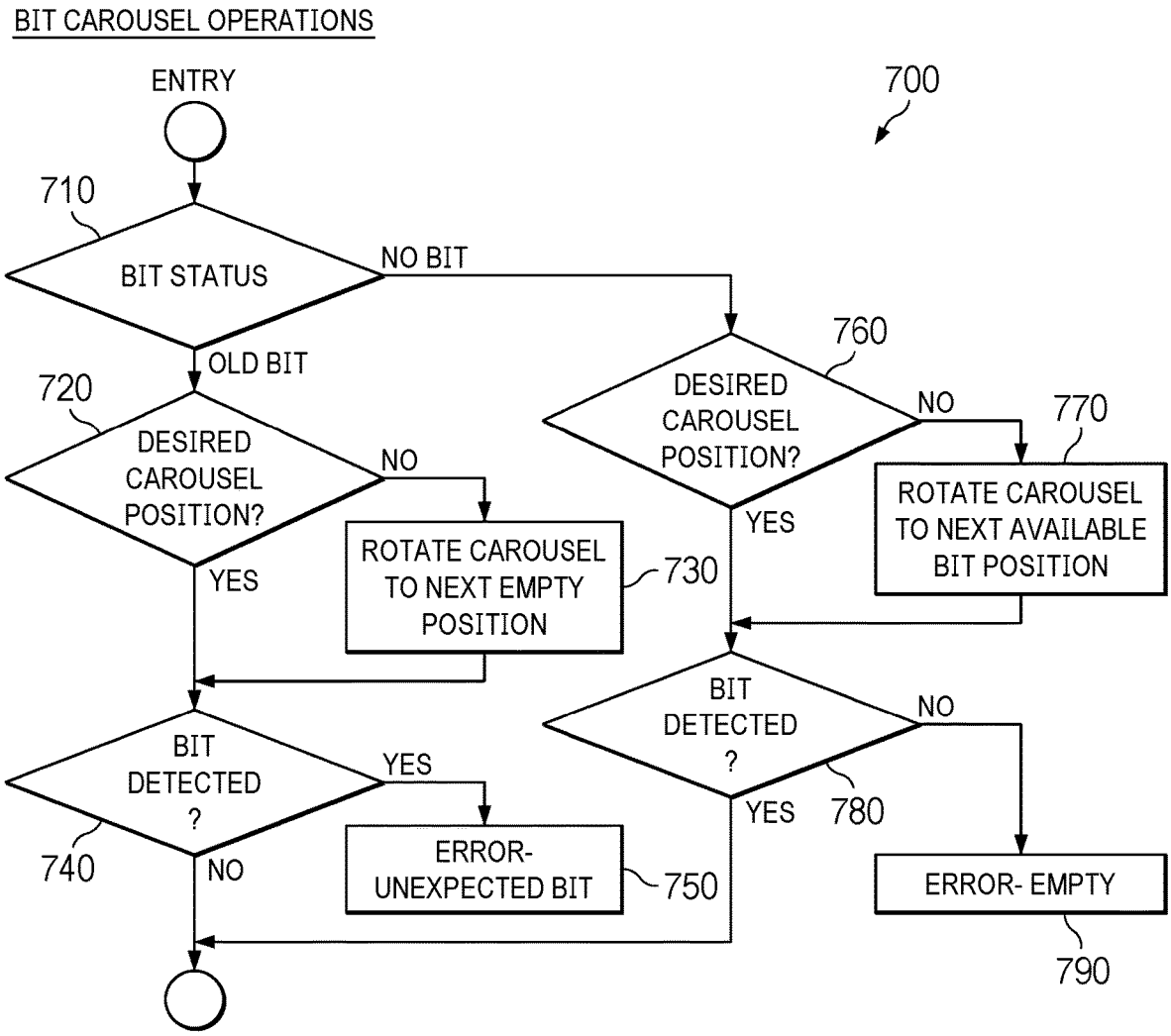
FIG. 18 is a flow chart describing the operations of the rotatable carousel assembly.

Step 530 in the method 500 is a process 600 for pivoting the tower and enclosure to the exchange position, as described in more detail in FIG. 17, and step 540 in the method is a process 700 for rotating the carousel to the desired position, as described in more detail in FIG. 18. Step 530 and step 540 are shown side-by-side in FIG. 16 to indicate that these processes 600, 700 can be conducted simultaneously, if desired, or sequentially, and in either order.

FIG. 17 depicts one implementation of a process 600 for pivoting the tower and the enclosure to the exchange position. The process 600 starts at step 610 with both the tower and the enclosure in the storage position. In step 620, the control system 155 sends a signal to unpin the vertical tower pins, which releases the tower. Then in step 630, the control system 155 sends a signal to an actuator to pivot the tower to the exchange position. Similarly, in step 640, the control system 155 sends a signal to actuators, such as lid actuators 210, to open the lid of the enclosure, and at step 650 the control system 155 sends a signal to actuators, such as changer actuators 225, to pivot the enclosure to the exchange position. The steps 620, 630 for unpinning and pivoting the tower, and the steps 640, 650 for opening the lid and pivoting the enclosure are shown side by side in FIG. 17 to indicate that these sets of steps can be conducted simultaneously, if desired, or sequentially, and in either order. The process 600 ends at step 660 with both the tower and the enclosure in the exchange position.

FIG. 18 depicts one implementation of a process 700 for rotating the carousel to the desired position. The process 700 starts at step 710 where the control system 155 proceeds along different operational paths depending on whether an old bit is attached to the drill string or no bit is attached to the drill string.

If an old bit is attached, the process 700 moves to step 720 where the control system 155 determines whether the carousel is in the desired position, namely, in a position where an empty bit adaptor is ready to receive the old drill bit. If the carousel is not in the desired position at step 720, then at step 730, the carousel is rotated to the next empty bit adaptor position. Once the carousel is in the desired position, then at step 740, a sensor reading is made to confirm that no bit is detected in the bit adaptor, which is expected to be empty. If a drill bit is detected in step 740, then an error is generated at step 750, indicating an unexpected bit. Otherwise, the process 700 ends when the old bit on the drill string is aligned with an empty bit adaptor in the carousel.

Returning to step 710, if no bit is attached, the process 700 moves to step 760 where the control system 155 determines whether the carousel is in the desired position, namely, in a position where a bit adaptor holding a new bit is aligned to be threaded onto the drill string. If the carousel is not in the desired position at step 760, then at step 770, the carousel is rotated to the next position where a new bit is available. Once the carousel is in the desired position, then at step 780, a sensor reading is made to confirm that a bit is detected in the bit adaptor. If a drill bit is not detected in step 780, then an error is generated at step 790, indicating an unexpected empty bit adaptor. Otherwise, the process 700 ends when the drill string with no bit attached is aligned with a new drill bit in the carousel.

Referring again to FIG. 16, once steps 530 and 540 are complete, the method 500 continues at step 550 with a bit to pipe joint operation comprising a process 800 that includes threading a new bit onto a drill string with no bit attached or unthreading an old bit from a drill string so that a new bit can be attached.

Figure 19:
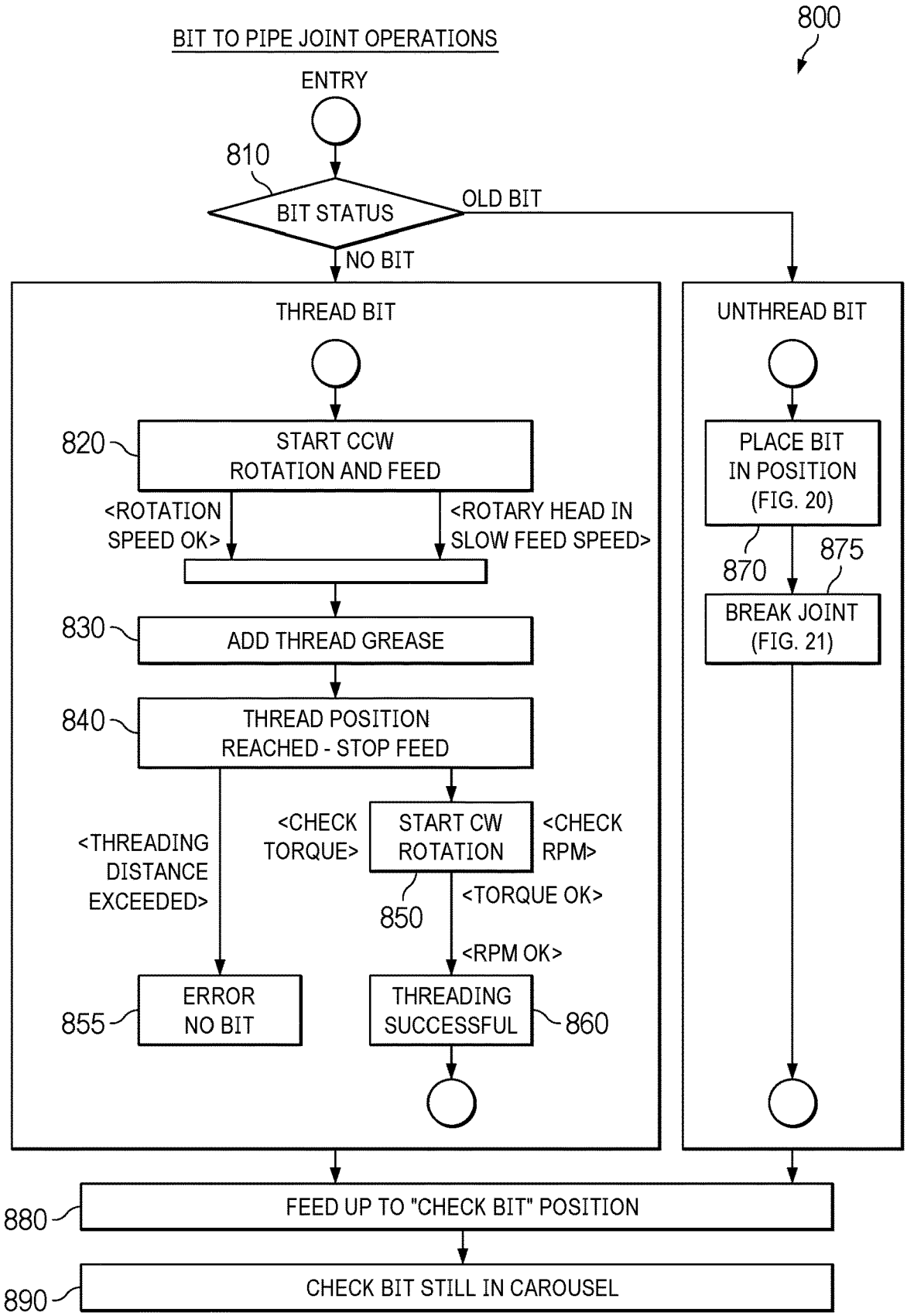
FIG. 19 is a flow chart describing the bit-to-pipe joint operations of the semi-automatic or automatic bit changer.

FIG. 19 depicts one implementation of a process 800 for bit to pipe joint operations. The process 800 starts at step 810 where the control system 155 proceeds along different operational paths depending on whether no bit is attached to the drill string or an old bit is attached to the drill string.

If no bit is attached to the drill string, then the process 800 comprises threading a bit onto the drill string in steps 820 through 860. In more detail, step 820 involves ensuring proper alignment between the drill string and the new bit to prevent cross threading during connection. In step 820, the rotary head carrying the drill string is rotated in a counter clockwise (CCW) direction and the receiving threads on the drill pipe at the end of the drill string are slowly fed toward the drill bit threads. This CCW rotation allows the drill bit to align with the drill pipe without catching on the threads. During step 820, the rotation speed is monitored and the rotary head is confirmed to be operating at a slow feed speed.

In step 830, thread grease is automatically added to the drill bit threads. In step 840, the threading distance is monitored, and once the drill pipe threads and the drill bit threads are bottomed out, the control system 155 recognizes that the thread position has been reached, and the rotary head stops rotating CCW and feeding the drill string toward the drill bit. However, if the threading distance is exceeded in step 840, then in step 855, the control system 155 will issue an error signal indicating that there is no bit.

In step 850, the rotary head is rotated in the clockwise (CW) direction to thread the drill pipe onto the drill bit. This CW rotation allows the receiving end threads of the drill string to engage and thread onto the drill bit threads. During this threading step 850, the torque is checked and the revolutions per minute (RPM) of the drill string are counted. In some implementations, an amplified sensor is used to count CW rotation pulses (or rotations) instead of RPM to accurately make small, controlled adjustments to the orientation (degrees of rotation) and to determine if cross threading has occurred.

If cross threading occurs, the torque will increase and the RPM will reduce to zero sooner than expected. In addition, since the CW rotation begins at a known position, the control system can estimate the number of rotations requires to tighten the joint, and if the joint is tightened in less rotations, then a cross thread error is generated. Otherwise, if the torque and RPM reach expected levels, then in step 860, the control system 155 will indicate that the threading was successful.

Returning to step 810, if an old bit is attached to the drill string, then the process 800 comprises unthreading the old bit from the drill string in steps 870 and 875. In more detail, step 870 comprises a process 900 of placing the old bit in position, as described in more detail in FIG. 20, and step 875 comprises a process 1000 of breaking the joint between the drill string and the old drill bit, as described in more detail in FIG. 21.

Figure 20:
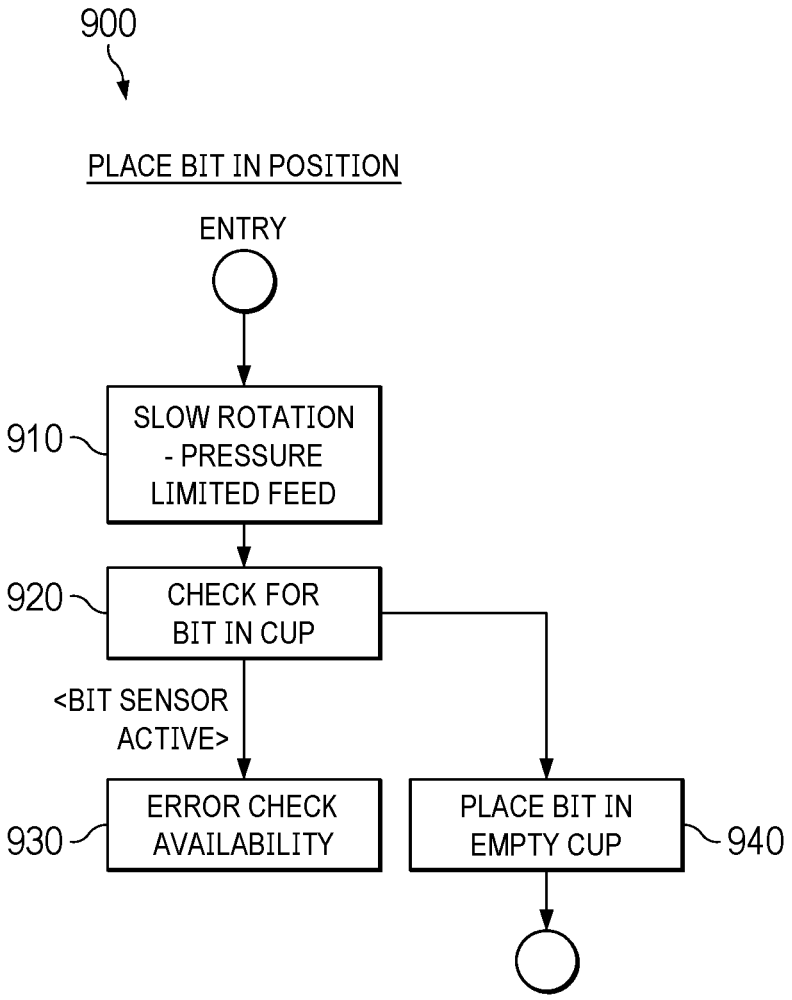
FIG. 20 is a flow chart describing the placing of a bit in position in a bit adaptor.

FIG. 20 depicts one implementation of a process 900 for placing an old drill bit attached to the drill string into an empty bit adaptor cup in the carousel. The process 900 begins at step 910 where the rotary head is slowly rotated while the old drill bit is fed toward the carousel via pressure-limited feed of the drill string. In step 920, to confirm that the bit adaptor cup is empty and ready to receive the old drill bit, a bit sensor checks the bit adaptor cup. If the bit sensor is activated, then in step 930, an error will be issued to indicate the bit adaptor cup is not available. Otherwise, if no bit is detected in the bit adaptor cup in step 920, then in step 940, the drill bit is placed in the empty bit adaptor cup.

Figure 21:
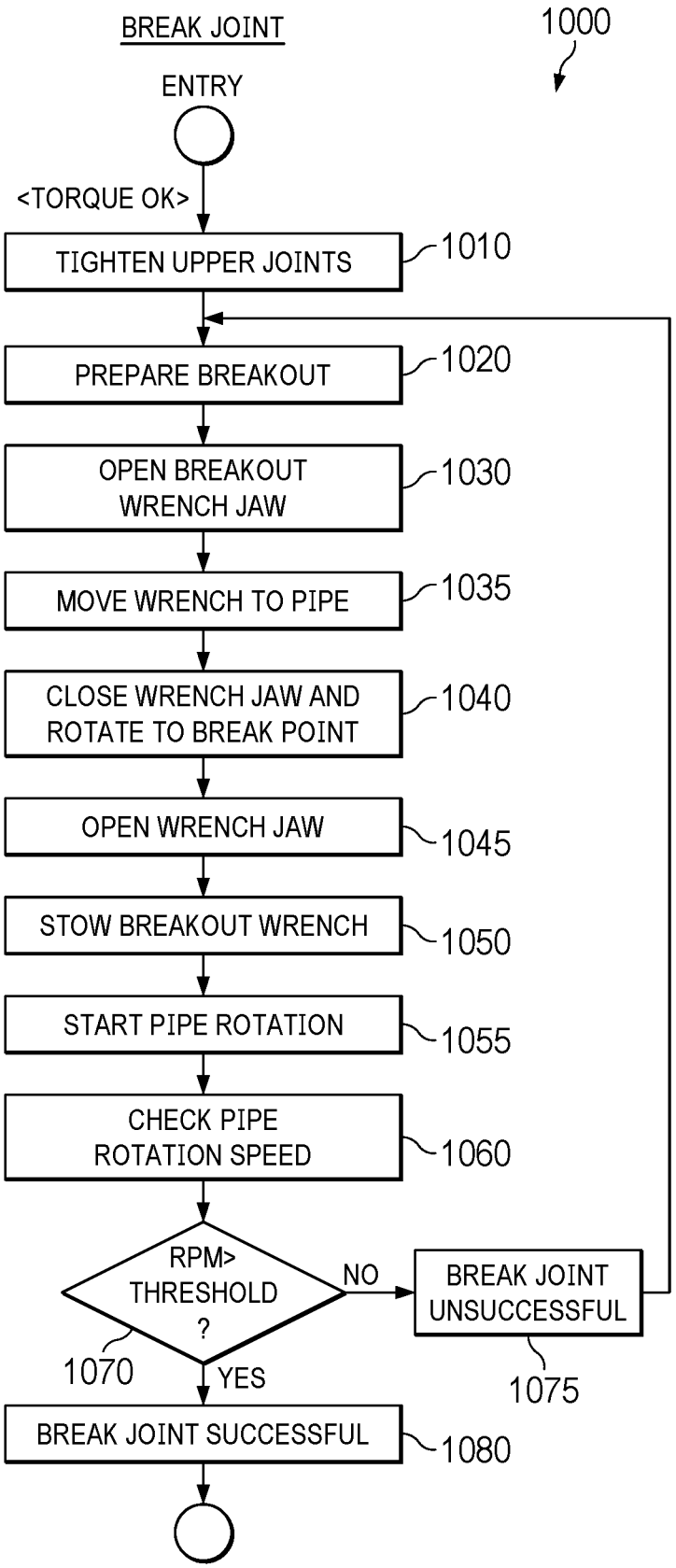
FIG. 21 comprises a flow chart describing the procedure for breaking a joint.

FIG. 21 depicts one implementation of a process 1000 for breaking the joint between the drill bit and the drill string once the old drill bit has been inserted into the empty bit adaptor cup. The process 1000 begins with step 1010 where the upper joints of the drill string are tightened by rotating the drill string in a clockwise (CW) direction before attempting to break the bit joint. During step 1010, the torque is monitored to determine when the upper joints have been sufficiently tightened.

In step 1020, the breakout is prepared by rotating the drill string counter clockwise (CCW) while the drill bit is held against the bit adaptor nubs to loosen the bit joint. Then in step 1030, the breakout wrench jaw is opened, and in step 1035, the breakout wrench is moved to the drill bit joint pipe. In step 1040, the wrench jaw is closed on the pipe, and the wrench is rotated to break the joint between the drill string and the bit joint. In step 1045, the wrench jaw is opened, and in step 1050, the breakout wrench is stowed.

In step 1055, the drill string is rotated CCW to disconnect the drill string threads from the drill bit joint threads. In step 1060, the speed of the pipe rotation is checked, and in step 1070 a determination is made whether the RPM is greater than a predetermined threshold that indicates if the break joint was successful in step 1080 or unsuccessful in step 1075. If the break joint was unsuccessful, the process 1000 returns to step 1020 to begin again.

Referring again to FIG. 19, once the new bit is threaded onto the drill string or the old bit is unthreaded from the drill string, then in step 880, the rotary head feeds the drill string up to a "check bit" position, and in step 890, a sensor checks to determine whether the bit adaptor cup aligned with the drill string is empty as expected if a new bit has been attached, or whether the bit adaptor cup contains the old drill bit that was unthreaded from the drill string.

In addition, if the bit adaptor cup is empty, the control system sets the availability of the bit in that bit adaptor cup to "In Ground" (attached), and if a bit is detected, the control system sets the availability of the bit in the adaptor cup to "No" (used bit). At the same time, the control system updates the status of the bit attached to the drill string to "No bit" attached or "New bit" attached. In addition, if the availability of the bit in the bit adaptor cup is set to "In Ground" (attached), the control system sets the "New bit" attached to the drill string as the effective bit so that the serial number, type of bit, size of bit, and depth tracking is automatically updated.

Once the process 800 of the bit to pipe joint operation is complete, the method 500 of FIG. 16 moves to step 560 where the control system 155 determines whether the drill string has a bit attached or not. If not, then the method 500 checks the availability of new bits in the carousel, and if a new bit is available to be added to the drill string, then the method 500 starts over again at step 510. Otherwise, if the drill string has a new bit attached at step 560, then in step 570, the method 500 conducts storage operations for the tower and enclosure, as described in more detail in FIG. 22.

Figure 22:
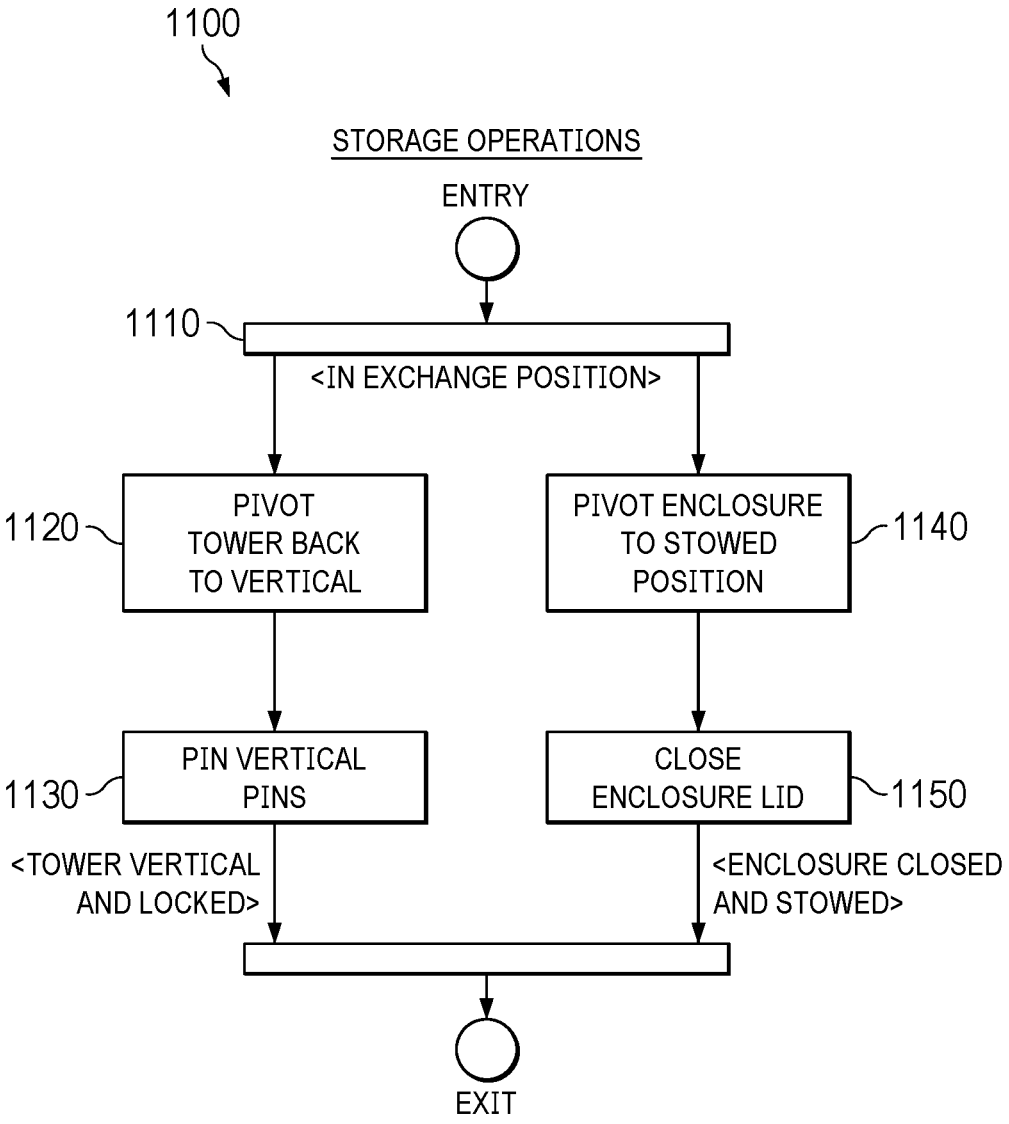
FIG. 22 is a flow chart describing storage operations.

FIG. 22 depicts one implementation of a process 1100 for returning the tower and the enclosure to the storage position. The process 1100 starts at step 1110 with both the tower and the enclosure in the exchange position. In step 1120, the control system 155 sends a signal to an actuator to pivot the tower back to the vertical storage position. Then in step 1130, the control system 155 sends a signal to pin the vertical tower pins, which locks the tower in the vertical position. Similarly, in step 1140, the control system 155 sends a signal to the actuators to pivot the enclosure to the stowed position. Then in step 1150, the control system 155 sends a signal to the actuator to close the lid of the enclosure so that the enclosure is closed and stowed. The steps 1120, 1130 for pivoting and pinning the tower, and the steps 1140, 1150 for pivoting the enclosure and closing the lid are shown side by side in FIG. 22 to indicate that these sets of steps can be conducted simultaneously, if desired, or sequentially, and in either order. The process 1100 ends at step 660 with both the tower and the enclosure in the stowed position. Referring again to FIG. 16, once the storage operations of step 570 are completed, the method 500 is likewise finished.

None of the descriptions in this application should be read as implying that any particular element, step, or function is an essential element which must be included in the claim scope; the scope of patented subject matter is defined only by the allowed claims. Moreover, none of these claims are intended to invoke 35 U.S.C. Section 112(f) unless the exact words "means for" are used, followed by a gerund. The claims as filed are intended to be as comprehensive as possible, and no subject matter is intentionally relinquished, dedicated, or abandoned.

The invention claimed is:

1. A method for changing drilling tools for a drilling rig, the drilling rig comprising a drill tower supporting a drill string with a drill pipe at the lowermost end, and a drilling tool changer assembly having a rotatable carousel assembly with a plurality of bit adaptors for holding drilling tools, the method comprising:

removing a first drilling tool attached to the drill pipe; and attaching a second drilling tool held in the rotatable carousel assembly to the drill pipe;

wherein the method is selectively performed automatically or semi-automatically via a control system operatively coupled to the drilling rig; and wherein when the method is performed semi-automatically, an input to the control system identifies which one or more of the method steps to perform automatically.

2. The method of claim 1, wherein before removing the first drilling tool attached to the drill pipe, the method further comprises:

moving the drill tower from a storage position to an exchange position; and moving the drilling tool changer assembly from a storage position to an exchange position.

3. The method of claim 2, wherein after attaching the second drilling tool held in the rotatable carousel assembly to the drill pipe, the method further comprises:

moving the drill tower from the exchange position to the storage position; and moving the drilling tool changer assembly from the exchange position to the storage position.

4. The method of claim 1, wherein removing the first drilling tool from the drill pipe comprises:

rotating the rotatable carousel assembly to bring a first bit adaptor that is initially empty into substantially coaxial alignment with the drill pipe.

5. The method of claim 4, further comprising:

placing the first drilling tool attached to the drill pipe into the first bit adaptor;

breaking a first joint between the first drilling tool and the drill pipe; and feeding up the drill pipe.

6. The method of claim 5, further comprising:

taking a sensor reading to determine whether the placing step was successful; and if the placing step was unsuccessful, reattempting the placing step;

wherein reattempting the placing step comprises:

feeding up the drill pipe;

rotating the drill pipe; and feeding down the drill pipe to place the first drilling tool attached to the drill pipe into the first bit adaptor.

7. The method of claim 5, further comprising:

taking a sensor reading to determine whether the placing step was successful; and if the placing step was successful, updating an availability status of the first bit adaptor to indicate the first bit adaptor contains the first drilling tool.

8. The method of claim 5, further comprising:

tightening the drill string before breaking the first joint;

wherein tightening the drill string comprises rotating the drill string in a clockwise direction.

9. The method of claim 8, wherein breaking the first joint comprises:

loosening the first joint with a breakout wrench; and rotating the drill pipe in a counterclockwise direction to unthread the first drilling tool from the drill pipe.

10. The method of claim 9, wherein breaking the first joint further comprises:

rotating the drill pipe in a counterclockwise direction to engage the first drilling tool against a set of nubs in the first bit adaptor before loosening the first joint with the breakout wrench.

11. The method of claim 1, wherein attaching the second drilling tool held in the rotatable carousel assembly to the drill pipe comprises:

rotating the rotatable carousel assembly to bring the second drilling tool held in a second bit adaptor into substantially coaxial alignment with the drill pipe;

threading the second drilling tool onto the drill pipe; and feeding up the drill pipe.

12. The method of claim 11, further comprising:

taking a sensor reading to determine whether the threading step was successful; and if the threading step was successful, updating an availability status of the second bit adaptor to indicate the second drilling tool was removed and the second bit adaptor is empty.

13. The method of claim 11, wherein threading the second drilling tool onto the drill pipe comprises:

rotating the drill pipe in a counter clockwise direction while feeding down the drill pipe toward the second drilling tool;

engaging and aligning the drill pipe and the second drilling tool;

rotating the drill pipe in a clockwise direction to thread onto the second drilling tool; and tightening a second joint between the drill pipe and the second drilling tool.

14. The method of claim 13, further comprising:

pre-determining a number of rotational pulses of the drill pipe in the clockwise direction required to tighten the second joint;

counting an actual number of rotational pulses of the drill pipe in the clockwise direction to tighten the second joint; and issuing a cross thread error if the counted number of rotational pulses is lower than the pre-determined number of rotational pulses.

15. The method of claim 14, wherein the actual number of rotational pulses is counted using an amplified sensor.

16. The method of claim 13, further comprising:

pre-determining a number of rotations of the drill pipe in the clockwise direction required to tighten the second joint;

counting an actual number of rotations of the drill pipe in the clockwise direction to tighten the second joint; and issuing a cross thread error if the counted number of rotations is lower than the pre-determined number of rotations.

17. The method of claim 1, further comprising:

setting the second drilling tool attached to the drill pipe as the effective bit; and tracking one or more of the following for the effective bit: a serial number, a type of bit, a diameter of bit, an aggressiveness of bit, and an operational parameter associated with use.

18. A method for changing drilling tools for a drilling rig, wherein the drilling rig comprises a drill tower supporting a drill pipe;

a drilling tool changer assembly moveable between a storage position and an exchange position;

the drilling tool changer assembly supporting a rotatable carousel assembly;

the rotatable carousel assembly having a plurality of bit adaptors for holding drilling tools; and the rotatable carousel assembly being selectively rotatable to bring a selected drilling tool into coaxial alignment with the drill pipe when the drilling tool changer assembly supporting the rotatable carousel assembly is moved into the exchange position; the method for changing drilling tools comprising:

removing a drilling tool attached to the drill pipe; and attaching the selected drilling tool held in the rotatable carousel assembly to the drill pipe;

wherein the method is selectively performed automatically or semi-automatically via input to a control system operatively coupled to the drilling rig; and wherein when the method is performed semi-automatically, any of the method steps may be performed manually, and the input identifies to the control system which of the method steps to perform automatically.

19. An apparatus for changing drilling tools for a drilling rig, wherein the drilling rig comprises a drill tower supporting a drill pipe; the apparatus for changing drilling tools comprising:

a drilling tool changer assembly moveable between a storage position and an exchange position;

the drilling tool changer assembly supporting a rotatable carousel assembly;

the rotatable carousel assembly having a plurality of bit adaptors for holding drilling tools;

the rotatable carousel assembly being selectively rotatable to bring a selected drilling tool into coaxial alignment with the drill pipe when the drilling tool changer assembly supporting the rotatable carousel assembly is moved into the exchange position; and a control system operatively coupled to the drilling rig to selectively remove a drilling tool from the drill pipe and attach the selected drilling tool to the drill pipe via an automatic or semi-automatic process;

wherein the control system comprises an interface for selecting between an automatic process or a semi-automatic process; and wherein when the semi-automatic process is selected, the control system receives input via the interface to identify which steps of the process to perform automatically.

* * * * *